US011139094B2

(12) United States Patent
Park et al.

(10) Patent No.: US 11,139,094 B2
(45) Date of Patent: Oct. 5, 2021

(54) POWER INDUCTOR

(71) Applicant: MODA-INNOCHIPS CO., LTD., Ansan-Si (KR)

(72) Inventors: In Kil Park, Seongnam-Si (KR); Gyeong Tae Kim, Ansan-Si (KR); Jun Ho Jung, Siheung-Si (KR); Seung Hun Cho, Siheung-Si (KR); Ki Joung Nam, Siheung-Si (KR)

(73) Assignee: MODA-INNOCHIPS CO., LTD.

( * ) Notice: Subject to any disclaimer, the term of this patent is extended or adjusted under 35 U.S.C. 154(b) by 542 days.

(21) Appl. No.: 15/778,223

(22) PCT Filed: Nov. 22, 2016

(86) PCT No.: PCT/KR2016/013441
§ 371 (c)(1),
(2) Date: May 22, 2018

(87) PCT Pub. No.: WO2017/090950
PCT Pub. Date: Jun. 1, 2017

(65) Prior Publication Data

US 2018/0366246 A1 Dec. 20, 2018

(30) Foreign Application Priority Data

Nov. 24, 2015 (KR) ..... 10-2015-0164930
Nov. 15, 2016 (KR) ..... 10-2016-0151997

(51) Int. Cl.
*H01F 21/04* (2006.01)
*H01F 1/057* (2006.01)
(Continued)

(52) U.S. Cl.
CPC ..... *H01F 1/057* (2013.01); *H01F 17/0013* (2013.01); *H01F 17/04* (2013.01);
(Continued)

(58) Field of Classification Search
USPC ..... 336/117, 200, 232
See application file for complete search history.

(56) References Cited

U.S. PATENT DOCUMENTS

2003/0030994 A1* 2/2003 Takaya ..... H01P 5/187 361/728
2009/0293339 A1 12/2009 Bartholomew
(Continued)

FOREIGN PATENT DOCUMENTS

CN 1793019 A 6/2006
CN 102674821 A 9/2012
(Continued)

OTHER PUBLICATIONS

Extended European Search Report for Application No. 16868846.3 dated Jun. 13, 2019.
(Continued)

*Primary Examiner* — Shawki S Ismail
*Assistant Examiner* — Kazi S Hossain
(74) *Attorney, Agent, or Firm* — Renaissance IP Law Group LLP

(57) ABSTRACT

Provided is a power inductor. The power inductor includes a body, at least one base material disposed within the body, at least one coil pattern disposed on at least one surface of the base material, an insulation layer disposed between the coil pattern and the body, and an external electrode disposed outside the body and connected to the coil pattern. The body includes a magnetic pulverized material and an insulation material.

16 Claims, 18 Drawing Sheets

(51) Int. Cl.

| | |
|---|---|
| ***H01F 17/04*** | (2006.01) |
| ***H01F 27/22*** | (2006.01) |
| ***H01F 27/29*** | (2006.01) |
| ***H01F 27/32*** | (2006.01) |
| ***H01F 17/00*** | (2006.01) |
| ***H01F 27/255*** | (2006.01) |
| *H01F 1/33* | (2006.01) |
| *H01F 27/00* | (2006.01) |

(52) U.S. Cl.

CPC ..... *H01F 27/22* (2013.01); *H01F 27/255* (2013.01); *H01F 27/29* (2013.01); *H01F 27/292* (2013.01); *H01F 27/32* (2013.01); *H01F 27/324* (2013.01); *H01F 1/33* (2013.01); *H01F 27/008* (2013.01); *H01F 2017/048* (2013.01)

(56) References Cited

U.S. PATENT DOCUMENTS

| | | | | |
|---|---|---|---|---|
| 2011/0007439 | A1 | 1/2011 | Asakawa et al. | |
| 2012/0274432 | A1 | 11/2012 | Jeong et al. | |
| 2013/0293334 | A1 | 11/2013 | Shin | |
| 2014/0001397 | A1 | 1/2014 | Park et al. | |
| 2014/0009254 | A1 | 1/2014 | Ohkubo et al. | |
| 2014/0167897 | A1* | 6/2014 | Choi ..... | H01F 41/0246 336/83 |
| 2014/0184374 | A1 | 7/2014 | Park et al. | |
| 2015/0187484 | A1 | 7/2015 | Jeong et al. | |
| 2015/0325362 | A1 | 11/2015 | Kumura et al. | |
| 2016/0314889 | A1* | 10/2016 | Ryu ..... | H01F 41/0246 |

FOREIGN PATENT DOCUMENTS

| | | | |
|---|---|---|---|
| CN | 103208343 | A | 7/2013 |
| CN | 103383886 | A | 11/2013 |
| CN | 103578708 | A | 2/2014 |
| CN | 104766692 | A | 7/2015 |
| CN | 104823324 | A | 8/2015 |
| CN | 105408967 | A | 3/2016 |
| JP | 2006310812 | A | 11/2006 |
| JP | 2007067214 | A | 3/2007 |
| JP | 2010016337 | A | 1/2010 |
| JP | 2013165251 | A | 8/2013 |
| JP | 2013251553 | A | 12/2013 |
| JP | 2014022724 | A | 2/2014 |
| JP | 2014130988 | A | 7/2014 |
| KR | 20070032259 | A | 3/2007 |
| KR | 20140011693 | A | 1/2014 |
| KR | 20140077346 | A | 6/2014 |
| KR | 20140085997 | A | 7/2014 |
| KR | 20150080800 | A | 7/2015 |
| TW | 201320124 | A | 5/2013 |
| TW | 201324555 | A | 6/2013 |
| TW | 201503179 | A | 1/2015 |
| WO | 2013042691 | A1 | 3/2013 |

OTHER PUBLICATIONS

Preliminary Report for PCT/KR2016/013441 dated Jun. 7, 2018.
Written Opinion for PCT/KR2016/013441 dated Feb. 10, 2017.
International Search Report for PCT/KR2016/013441 dated Feb. 10, 2017.

* cited by examiner

POWER INDUCTOR

TECHNICAL FIELD

The present disclosure relates to a power inductor, and more particularly, to a power inductor having superior inductance properties and improved insulation properties and thermal stability.

BACKGROUND ART

A power inductor is mainly provided in a power circuit such as a DC-DC converter within a portable device. The power inductor is increasing in use, instead of an existing wire wound choke coil as the power circuit is switched at a high frequency and miniaturized. Also, the power inductor is being developed in the manner of miniaturization, high current, low resistance, and the like as the portable device is reduced in size and multi-functionalized.

The power inductor according to the related art is manufactured in a shape in which a plurality of ferrites or ceramic sheets mode of a dielectric having a low dielectric constant are laminated. Here, a coil pattern is formed on each of the ceramic sheets. The coil pattern formed on each of the ceramic sheets is connected to the ceramic sheet by a conductive via, and the coil patterns overlap each other in a vertical direction in which the sheets are laminated. Also, in the related art, the body in which the ceramic sheets are laminated may be generally manufactured by using a magnetic material composed of a four element system of nickel (Ni), zinc (Zn), copper (Cu), and iron (Fe).

However, the magnetic material has a relatively low saturation magnetization value when compared to that of the metal material. Thus, the magnetic material may not realize high current properties that are required for the recent portable devices. As a result, since the body constituting the power inductor is manufactured by using metal magnetic powder, the power inductor may relatively increase in saturation magnetization value when compared to the body manufactured by using the magnetic material. However, if the body is manufactured by using the metal, an eddy current loss and a hysteresis loss of a high frequency wave may increase to cause serious damage of the material.

To reduce the loss of the material, a structure in which the metal magnetic powder is insulated from each other by a polymer is applied. That is, sheets in which the metal magnetic powder and the polymer are mixed with each other are laminated to manufacture the body of the power inductor. Also, a predetermined base material on which a coil pattern is formed is provided inside the body. That is, the coil pattern is formed on the predetermined base material, and a plurality of sheets are laminated and compressed on top and bottom surfaces of the coil pattern to manufacture the power inductor.

However, since the power inductor using the metal magnetic powder and the polymer has low magnetic permeability because the metal magnetic powder does not maintain its proper physical property as it is. Also, since the polymer surrounds the metal magnetic powder, the magnetic permeability of the body may be reduced.

PRIOR ART DOCUMENTS

Korean Patent Publication No. 2007-0032259

DISCLOSURE OF THE INVENTION

Technical Problem

The present disclosure provides a power inductor that is capable of improving magnetic permeability.

The present disclosure also provides a power inductor that is capable of improving magnetic permeability of a body to improve overall magnetic permeability.

The present disclosure also provides a power inductor that is capable of preventing an external electrode from being short-circuited.

Technical Solution

In accordance with an exemplary embodiment, a power inductor includes: a body; at least one base material disposed within the body; at least one coil pattern disposed on at least one surface of the base material; an insulation layer disposed between the coil pattern and the body; and an external electrode disposed outside the body and connected to the coil pattern, wherein the body includes a magnetic pulverized material and an insulation material.

The power inductor may further include an insulation capping layer disposed on an upper portion of the body.

The capping insulation layer may be disposed on at least a portion of a remaining area except for an area on which the external electrode is mounted on a printed circuit board.

The magnetic pulverized material may be manufactured by pulverizing a magnetic sintered body to a predetermined size.

The body may further include metal magnetic powder and a thermal conductive filler.

In the body, a content of the metal magnetic powder may be greater than that of the magnetic pulverized material.

The thermal conductive filler may include at least one selected from the group consisting of MgO, AlN, carbon-based materials, Ni-based ferrite, and ferrite.

The power inductor may further include at least one magnetic layer disposed on the body.

The magnetic layer may be manufactured by mixing at least one of the magnetic pulverized material and metal magnetic powder with the insulation material or by using a magnetic sintered body or a metal ribbon.

At least a region of the base material may be removed, and the body may be filled into the removed region.

The magnetic layer and the insulation layer may be alternately disposed in the removed region of the base material, or a magnetic material may be disposed in the removed region of the base material.

The coil patterns disposed on the one surface and the other surface of the base material may have the same height.

At least one region of the coil pattern may have a different width.

The insulation layer may be disposed on top and side surfaces of the coil pattern at the uniform thickness and have the same thickness as each of top and side surfaces of the coil pattern on the base material.

At least a portion of the external electrode may be made of the same material as the coil pattern.

The coil pattern may be formed on at least one surface of the base material through a plating process, and an area of the external electrode, which contacts the coil pattern, may be formed through the plating process.

In accordance with another exemplary embodiment, a power inductor includes: a body; at least one base material disposed within the body; at least one coil pattern disposed on at least one surface of the base material; and an external electrode disposed outside the body, wherein the body includes metal magnetic powder, a magnetic pulverized material, and an insulation material.

The body may further include a thermal conductive filler.

A content of the metal magnetic powder may be greater than that of the magnetic pulverized material.

0.1 wt % to 5 wt % of the magnetic pulverized material may be contained with respect to 100 wt % of a mixture of the metal magnetic powder and the magnetic pulverized material.

Advantageous Effects

In the power inductor in accordance to the exemplary embodiments, the body may be manufactured by mixing the magnetic pulverized material that is objected by pulverizing the magnetic material with the insulation material. Also, at least one magnetic layer in which the magnetic pulverized material is mixed may be formed within the body. Since the body is manufactured by using the magnetic pulverized material having magnetic permeability greater than that of the magnetic powder, the magnetic permeability of the body may be improved. Therefore, the overall magnetic permeability of the power inductor may be improved.

Also, since the parylene is applied on the coil pattern, the parylene having the uniform thickness may be formed on the coil pattern, and thus, the insulation between the body and the coil pattern may be improved.

Also, the base material that is provided inside the body and on which the coil pattern is formed may be manufactured by using the metal magnetic material to prevent the power inductor from being deteriorated in magnetic permeability. In addition, at least a portion of the base material may be removed to fill the body in the removed portion of the base material, thereby improving the magnetic permeability. Also, at least one magnetic layer may be disposed on the body to improve the magnetic permeability of the power inductor.

The insulation capping layer maybe formed on the top surface of the body, on which the external electrode is formed, to prevent the external electrode, the shield can, and the adjacent components from being short-circuited therebetween.

BRIEF DESCRIPTION OF THE DRAWINGS

Exemplary embodiments can be understood in more detail from the following description taken in conjunction with the accompanying drawings, in which.

MODE FOR CARRYING OUT THE INVENTION

Hereinafter, specific embodiments will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

Figure 1:
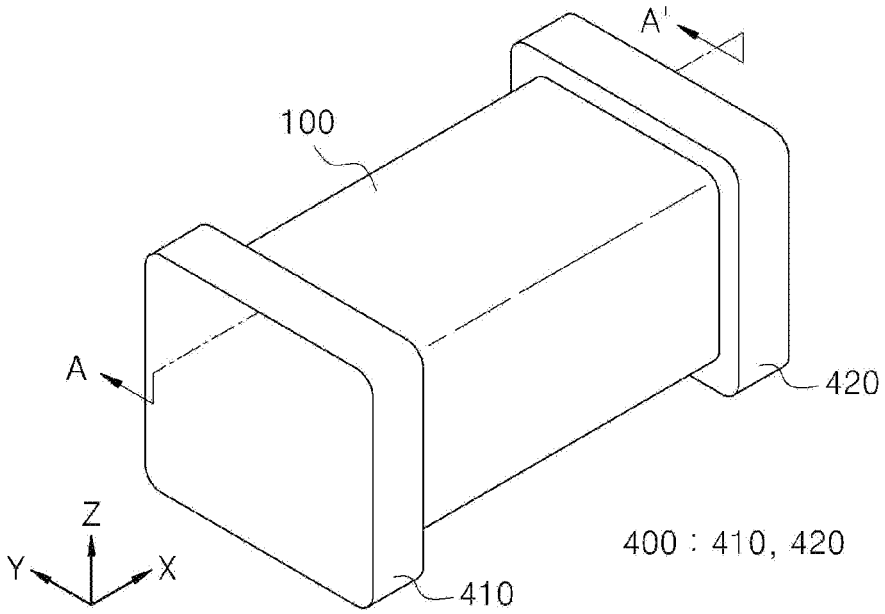
FIG. 1 is a combined perspective view of a power inductor in accordance with an exemplary embodiment.
Figure 2:
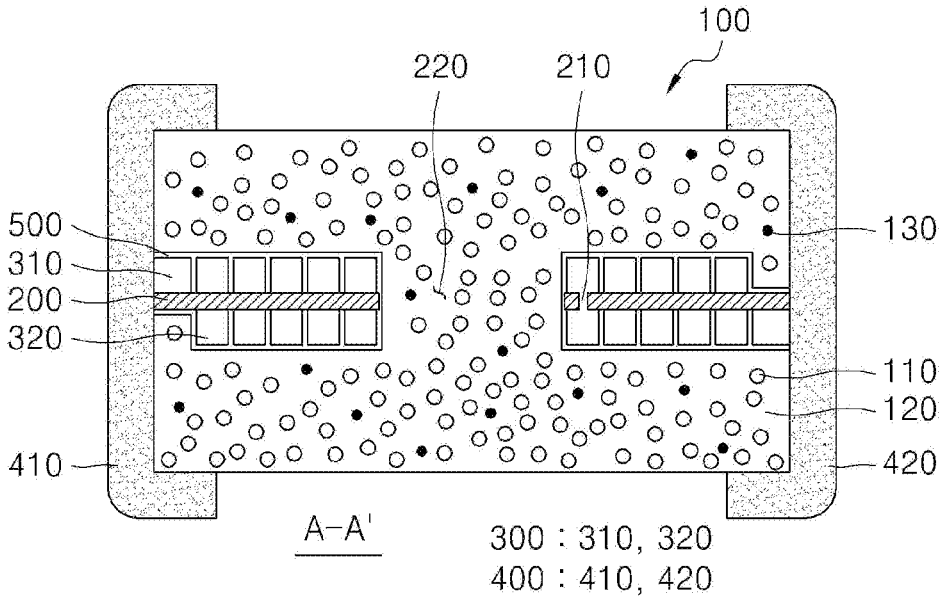
FIG. 2 is a cross-sectional view taken along line A-A' of FIG. 1.
Figure 3:
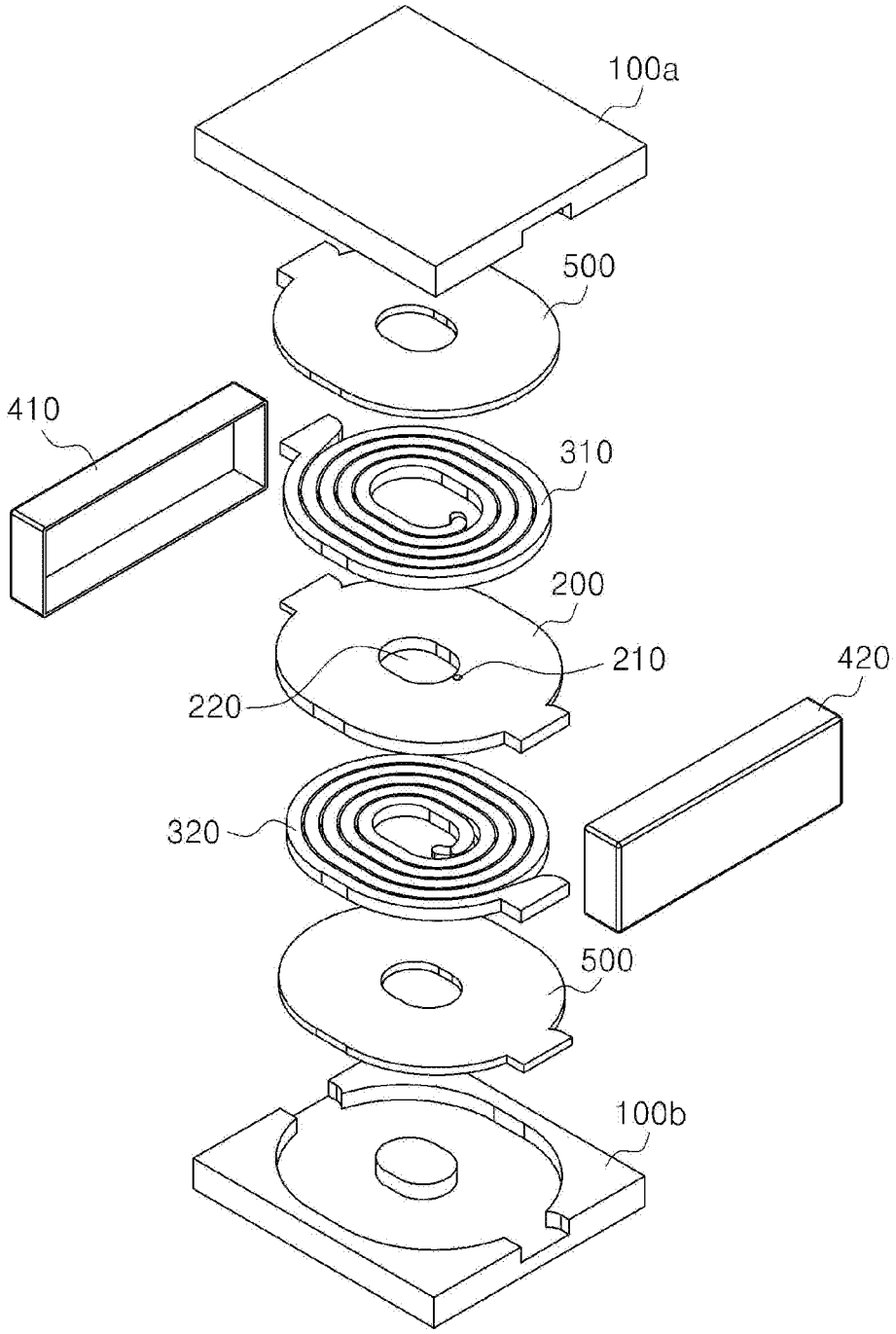
FIGS. 3 and 4 are an exploded perspective view and a partial plan view of the power inductor in accordance with an exemplary embodiment.
Figure 4:
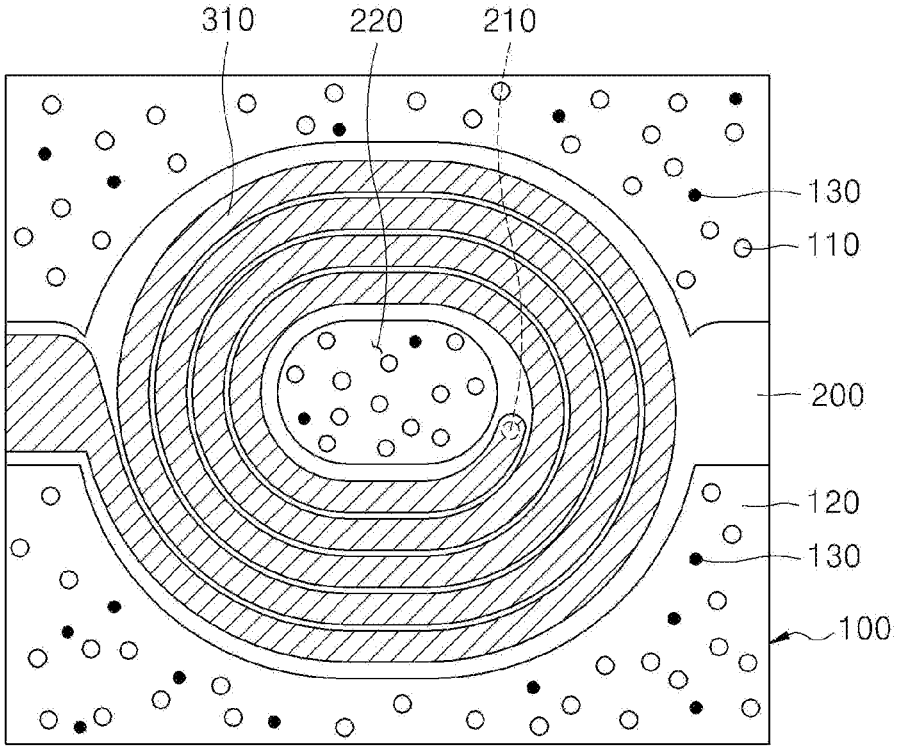
Figure 5:
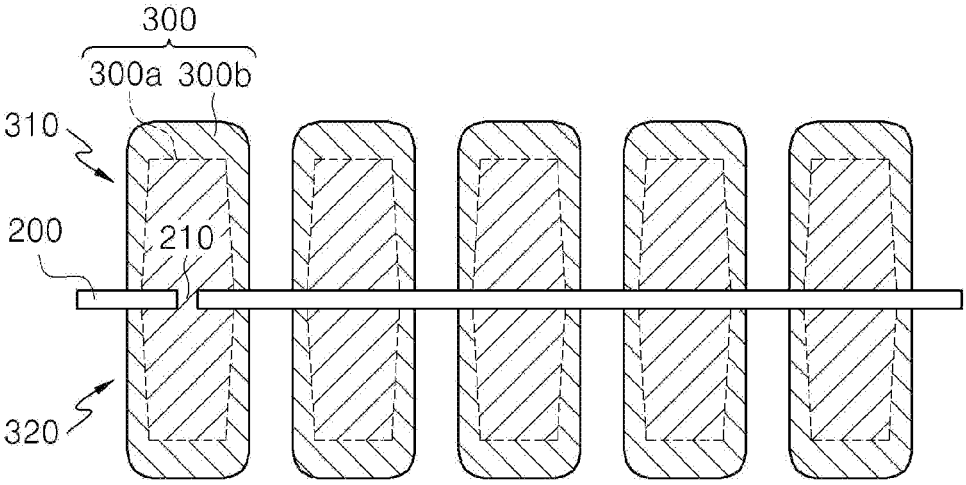
FIGS. 5 and 6 are cross-sectional views illustrating a base material and a coil pattern so as to explain a shape of the coil pattern.
Figure 6:
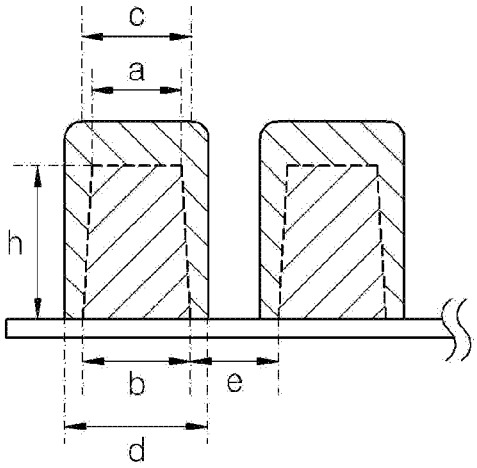
Figure 7:
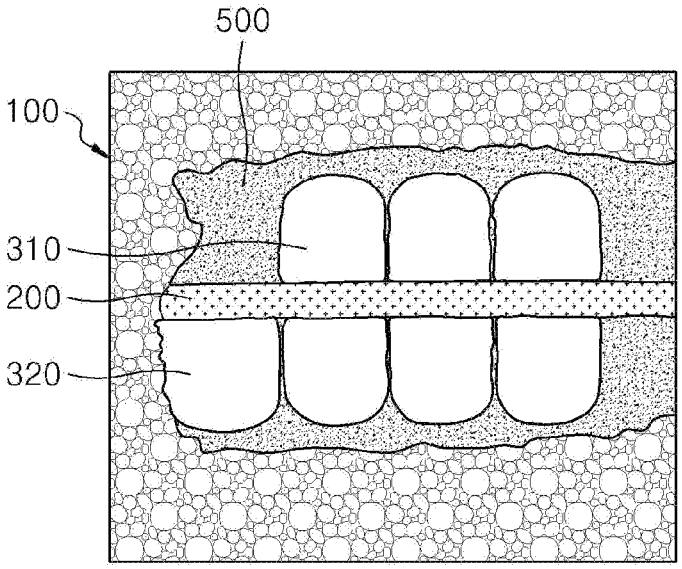
FIGS. 7 and 8 are cross-sectional images of the power inductor depending on materials of an insulation layer.
Figure 8:
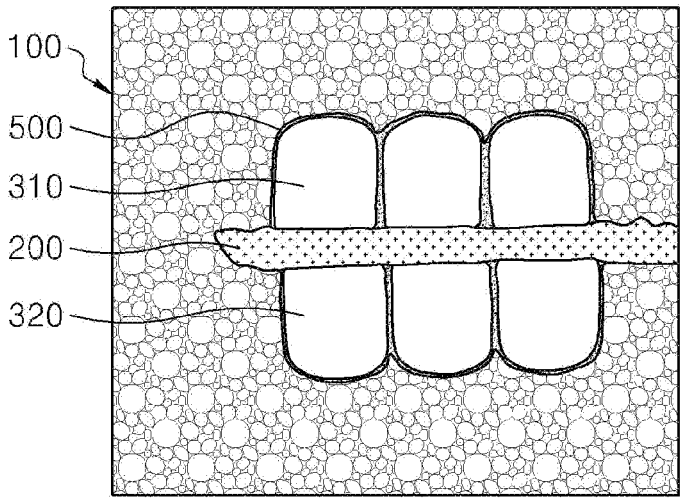
Figure 9:
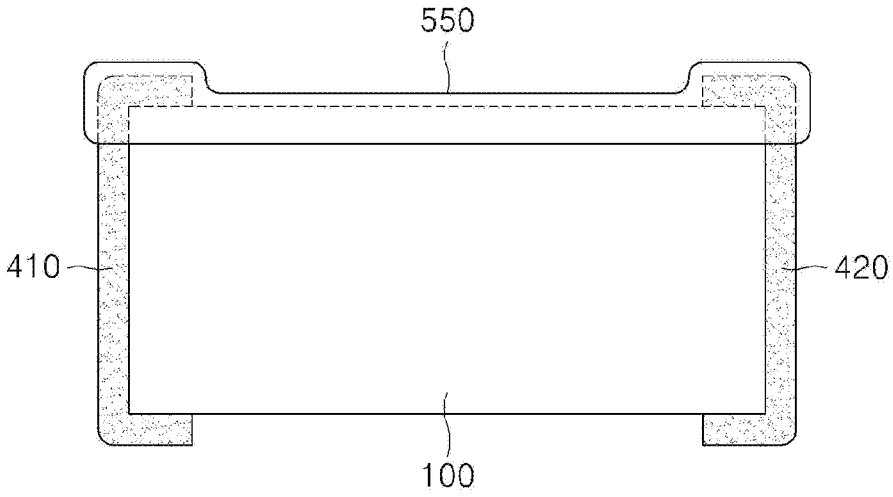
FIG. 9 is a side view illustrating the power inductor in accordance with a modified example of an exemplary embodiment.

FIG. 1 is a combined perspective view of a power inductor in accordance with an exemplary embodiment, FIG. 2 is a cross-sectional view taken along line A-A' of FIG. 1, and FIG. 3 is an exploded perspective view. Also, FIG. 4 is a plan view of a base material and a coil pattern, FIGS. 5 and 6 are cross-sectional views illustrating the base material and the coil pattern so as to explain a shape of the coil pattern, and FIGS. 7 and 8 are cross-sectional images of the power inductor depending on materials of an insulation layer. FIG. 9 is a side view illustrating the power inductor in accordance with a modified example of an exemplary embodiment.

Referring to FIGS. 1 to 8, a power inductor in accordance with an exemplary embodiment may include a body 100 (100*a* and 100*b*), a base material 200 provided in the body 100, a coil pattern 300 (310 and 320) disposed on at least one surface of the base material 200, and an external electrode 400 (410 and 420) disposed outside the body 100. Also, an insulation layer 500 may be further disposed between the coil pattern 300 and the body 100.

1. Body

The body 100 may have a hexahedral shape. That is, the body 100 may have an approximately hexahedral shape having a predetermined length in an X direction, a predetermined width in a Y direction, and a predetermined height in a Z direction. Here, the body 100 may have the length that is greater than each of the width and height and have the width that is equal to or different from the height. Alternatively, the body 100 may have a polyhedral shape in addition to the hexahedral shape. The body 100 may includes a magnetic pulverized material 110 and an insulation material 120. That is the magnetic pulverized material 110 and the insulation material 120 may be mixed with each other to form the body 100. Also, the body 100 may further include a thermal conductive filler 130 and metal magnetic powder (not shown). That is, the body 100 may include the magnetic pulverized material 110 and the insulation material 120 and further include at least one of the thermal conductive filler 130 and the metal magnetic powder.

The magnetic pulverized material 110 may be formed by pulverizing a magnetic sintered body having the form of a sheet with a predetermined thickness. That is, the magnetic powder may be ball-milled and pulverized, and then a binder is put to mold a predetermined body. Then, the predetermined body may be compressed and de-bound and then sintered to manufacture a magnetic sintered body. Then, the magnetic sintered body may be pulverized to a predetermined size to form the magnetic pulverized material 110. The magnetic pulverized material 110 may be mixed with the insulation material 120 to form the body 100. The magnetic pulverized material 110 may be manufactured by using an alloy to which Si, B, Nb, Cu, and the like are added on the basis of Fe. For example, the magnetic pulverized material 110 may include at least one magnetic metal selected from the group consisting of Fe—Si, Fe—Ni—Si, Fe—Si—B, Fe—Si—Cr, Fe—Si—Al, Fe—Si—B—Cr, Fe—Al—Cr, Fe—Si—B—Nb—Cu, and Fe—Si—Cr—B—Nb—Cu. That is, the magnetic pulverized material 110 may be formed using at least one of an FeSi-based material, an FeNiSi-based material, an FeSiB-based material, an FeSiCr-based material, an FeSiAl-based material, an FeSiBCr-based material, an FeAlCr-based material, an FeSiBNbCu-based material, and an FeSiCrBNbCu-based material. Also, the magnetic pulverized material may use at least one selected from the group consisting of NiO—ZnO—CuO-based ferrite, NiO—ZnO-based ferrite, MnO—ZnO—CuO-based ferrite, and MnO—ZnO-based ferrite or at least one oxide magnetic material thereof. For example, the magnetic pulverized material may include NiO.ZnO.CuO—$Fe_2O_3$ and MnO.ZnO.CuO—$Fe_2O_3$. That is, the magnetic pulverized material 110 may use metal oxide-based ferrite. The magnetic pulverized material 110 may have an irregular shape and a plurality of sizes because the magnetic pulverized material 110 is formed by pulverizing a magnetic sintered body. For example, the magnetic pulverized material 110 may have a triangular shape, a rectangular shape, or various polygonal shapes with a predetermined thickness. Alternatively, the magnetic pulverized material 110 may have a size less than that of a plane of the body 100. For example, the magnetic pulverized material 110 may have a mean particle diameter of 0.1 μm to about 150 μm. Also, one kind of particles having the same size or at least two kinds of particles may be used as the magnetic pulverized material 110. Also, the one kind of particles having a plurality of sizes or at least two kinds of particles may be used as the magnetic pulverized material 110. However, since it is difficult to pulverize the magnetic pulverized material 110 to the same size when the magnetic sintered body is pulverized, the single kind or at least two kinds of materials having the plurality of sizes may be used as the magnetic pulverized material 110. Here, the magnetic pulverized material 110 may have a desired mean particle diameter through sieving. When the at least two kinds of magnetic pulverized materials 110 having sizes different from each other are used, the body 100 may be increased in filling rate and thus maximized in capacity. For example, when the magnetic pulverized materials 110 having a mean particle diameter of 50 μm are used, a pore may be generated between the magnetic pulverized materials 110, and thus, the filling rate may be decreased. Thus, the magnetic pulverized materials 110 having a relatively less mean particle diameter, e.g., a mean particle diameter of 3 μm may be mixed with the magnetic pulverized materials 110 having a mean particle diameter of 50 μm to increase the filling rate of the magnetic pulverized material 110 within the body 100. When the magnetic pulverized materials 110 contact each other, the insulation may be broken to cause short-circuit. Thus, the surface of the magnetic pulverized material 110 may be coated with at least one insulation material. For example, the surface of the magnetic pulverized material 110 may be coated with oxide or an insulation polymer material such as parylene. Preferably, the surface of the magnetic pulverized material 110 may be coated with the parylene. The parylene may be coated to a thickness of 1 μm to 10 μm. Here, when the parylene is formed to a thickness of 1 μm or less, an insulation effect of the magnetic pulverized material 110 may be deteriorated. When the parylene is formed to a thickness exceeding 10 μm, the magnetic pulverized material 110 may increase in size to reduce distribution of the magnetic pulverized material 110 within the body 100, thereby deteriorating the magnetic permeability. Also, the surface of the magnetic pulverized material 110 may be coated with various insulation polymer materials in addition to the parylene. The oxide applied to the magnetic pulverized material 110 may be formed by oxidizing the magnetic pulverized material 110. Alternatively, the magnetic pulverized material 110 may be coated with at least one selected from $TiO_2$, $SiO_2$, $ZrO_2$, $SnO_2$, NiO, ZnO, CuO, CoO, MnO, MgO, $Al_2O_3$, $Cr_2O_3$, $Fe_2O_3$, $B_2O_3$, and Bi2O3. Here, the magnetic pulverized material 110 may be coated with oxide having a double structure. That is, the magnetic pulverized material 110 may be coated with a double structure of the oxide and the polymer material. Since the surface of the magnetic pulverized material 110 is coated with the insulation material, the short-circuit due to the contact between the magnetic pulverized materials 110 may be prevented. Here, when the magnetic pulverized material 110 is coated with the oxide or the insulation polymer or doubly coated with the oxide or the insulation polymer, the magnetic pulverized material 110 may be coated to a thickness of 1 μm to 10 μm.

The insulation material 120 may be mixed with the magnetic pulverized material 110 to insulate the magnetic pulverized materials from each other. The insulation material 120 may include at least one selected from the group consisting of epoxy, polyimide, and liquid crystalline polymer (LCP), but is not limited thereto. Also, the insulation material 120 may be disposed between the magnetic pulverized materials 110 and made of a thermosetting resin. For example, the thermosetting resin may include at least one selected from the group consisting of a novolac epoxy resin, a phenoxy type epoxy resin, a BPA type epoxy resin), a BPF type epoxy resin), a hydrogenated BPA epoxy resin), a dimer acid modified epoxy resin, an urethane modified epoxy resin), a rubber modified epoxy resin, and a DCPD type epoxy resin. Here, the insulation material 120 may be contained at a content of 2.0 wt % to 15.0 wt % with respect to 100 wt % of the magnetic pulverized material 110. However, if the content of the insulation material 120 increases, a volume fraction of the magnetic pulverized material 110 may be reduced, and thus, it is difficult to properly realize an effect in which a saturation magnetization value increases. Thus, the magnetic permeability of the body 100 may be deteriorated. On the other hand, if the content of the insulation material 120 decreases, a strong acid solution or a strong alkali solution that is used in a process of manufacturing the inductor may be permeated inward to reduce inductance properties. Thus, the insulation material 120 may be contained within a range in which the saturation magnetization value and the inductance of the magnetic pulverized material 110 are not reduced.

Metal magnetic powder (not shown) together with the magnetic pulverized material 110 may be mixed in the body 100. The metal magnetic powder may have a mean particle diameter of 0.1 μm to about 200 μm. Here, the metal magnetic powder may have a size equal to or different from that of the magnetic pulverized material 110. That is, the metal magnetic powder may have a size greater or less than that of the magnetic pulverized material 110 or have the same size as the magnetic pulverized material 110. Also, one kind of particles having the same size or at least two kinds of particles may be used as the metal magnetic powder. The one kind of particles having a plurality of sizes or at least two kinds of particles may be used as the metal magnetic powder. When the at least two kinds of metal magnetic powder having sizes different from each other are used, the body 100 may be increased in filling rate and thus maximized in capacity. Here, the metal magnetic powder may be contained at a contact that is greater or less than that of the magnetic pulverized material 110. That is, the magnetic pulverized material 110 may be contained at a content of 0.1 wt % to 99.9 wt %, and the metal magnetic powder may be contained at a content of 99.9 wt % to 0.1 wt % with respect to 100 wt % of the mixture of the magnetic pulverized material 110 and the metal magnetic powder. For example, the magnetic pulverized material 110 may be contained at a content of 0.1 wt % to 10 wt %, and the metal magnetic powder may be contained at a content of 90 wt % to 99.9 wt % with respect to 100 wt % of the mixture of the magnetic pulverized material 110 and the metal magnetic powder. Preferably, the magnetic pulverized material 110 may be contained at a content of 0.1 wt % to 5 wt %, and the metal magnetic powder may be contained at a content of 95 wt % to 99.9 wt %. Alternatively, the magnetic pulverized material 110 may be contained at a content of 90 wt % to 99.9 wt %, and the metal magnetic powder may be contained at a content of 0.1 wt % to 10 wt %. Here, since the magnetic pulverized material 110 is added to a content of 10 wt % or less, preferably, 5 wt %, more preferably, 1 wt %, withstanding voltage characteristics may be improved while maintaining the magnetic permeability of the power inductor. For example, the withstanding voltage characteristics due to the repeat applying of the ESD may be improved by approximately 10% when compared to the withstanding voltage characteristics when the magnetic pulverized material 110 is not added. The metal magnetic powder may be manufactured by using an alloy to which Si, B, Nb, Cu, and the like are added on the basis of Fe. For example, the magnetic pulverized material 110 may include at least one magnetic metal selected from the group consisting of Fe—Si, Fe—Ni—Si, Fe—Si—B, Fe—Si—Cr, Fe—Si—Al, Fe—Si—B—Cr, Fe—Al—Cr, Fe—Si—B—Nb—Cu, and Fe—Si—Cr—B—Nb—Cu. Also, the metal magnetic powder may use at least one selected from the group consisting of NiO—ZnO—CuO-based ferrite, NiO—ZnO-based ferrite, MnO—ZnO—CuO-based ferrite, and MnO—ZnO-based ferrite or at least one oxide magnetic material thereof. That is, the same component as the magnetic pulverized material 110 may be used as the metal magnetic powder. That is, the same component as the magnetic pulverized material 110 and having a content different from that of the magnetic pulverized material 110 may be used as the metal magnetic powder. Also, a surface of the metal magnetic powder may be coated with a magnetic material. Here, the magnetic material may have magnetic permeability different from that of the metal magnetic powder. For example, the magnetic materials may include a metal oxide magnetic material. The metal oxide magnetic material may include at least one selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material. That is, the magnetic material applied to the surface of the metal magnetic powder may include metal oxide including iron and have magnetic permeability greater than that of the metal magnetic powder. Since the metal magnetic powder has magnetism, when the metal magnetic powder contact each other, the insulation may be broken to cause short-circuit. Thus, the surface of the metal magnetic powder may be coated with at least one insulation material. For example, the surface of the metal magnetic powder may be coated with oxide or an insulation polymer material such as parylene. Preferably, the surface of the metal magnetic powder may be coated with the parylene. The parylene may be coated to a thickness of 1 μm to 10 μm. Here, when the parylene is formed to a thickness of 1 μm or less, an insulation effect of the metal magnetic powder may be deteriorated. When the parylene is formed to a thickness exceeding 10 μm, the metal magnetic powder may increase in size to reduce distribution of the metal magnetic powder within the body 100, thereby deteriorating the magnetic permeability. Also, the surface of the metal magnetic powder may be coated with various insulation polymer materials in addition to the parylene. The oxide applied to the metal magnetic powder may be formed by oxidizing the metal magnetic powder. Alternatively, the metal magnetic powder may be coated with at least one selected from $TiO_2$, $SiO_2$, $ZrO_2$, $SnO_2$, NiO, ZnO, CuO, CoO, MnO, MgO, $Al_2O_3$, $Cr_2O_3$, $Fe_2O_3$, $B_2O_3$, and $Bi_2O_3$. Here, the metal magnetic powder may be coated with oxide having a double structure. Thus, the metal magnetic powder may be coated with a double structure of the oxide and the polymer material. Alternatively, the surface of the metal magnetic powder may be coated with an insulation material after being coated with the magnetic material. Since the surface of the metal magnetic powder is coated with the insulation material, the short-circuit due to the contact between the metal magnetic powder may be prevented.

The body 100 may include a thermal conductive filler 130 to solve the limitation in which the body 100 is heated by external heat. That is, the magnetic pulverized material 110 of the body 100 may be heated by external heat. Thus, the thermal conductive filler 130 may be provided to easily release the heat of the magnetic pulverized material 110 to the outside. The thermal conductive filler 130 may include at least one selected from the group consisting of MgO, AlN, carbon-based materials, Ni-based ferrite, and Mn-based ferrite, but is not limited thereto. Here, the carbon-based material may include carbon and have various shapes. For example, the carbon-based material may include graphite, carbon black, graphene, and the like. Also, the Ni-based ferrite may include NiO.ZnO.CuO—$Fe_2O_3$, and the Mn-based ferrite may include MnO.ZnO.CuO—$Fe_2O_3$. Here, the thermal conductive filler may be made of a ferrite material to improve the magnetic permeability or prevent the magnetic permeability from being deteriorated. The thermal conductive filler 130 may be dispersed and contained in the insulation material 120 in the form of powder. Also, the thermal conductive filler 130 may be contained at a content of 0.5 wt % to 3 wt % with respect to 100 wt % of the magnetic pulverized material 110. When the thermal conductive filler 130 has a content less than the above-described range, it may be difficult to obtain a heat releasing effect. On the other hand, when the thermal conductive filler 130 has a content exceeding the above-described range, a content of the magnetic pulverized material 110 may be reduced to deteriorate the magnetic permeability of the body 100. Also, the thermal conductive filler 130 may have a size of, for example, 0.5 μm to 100 μm. That is, the thermal conductive filler 130 may have the same size as the magnetic pulverized material 110 or a size less than that of the magnetic pulverized material 110. The heat releasing effect may be adjusted in accordance with a size and content of the thermal conductive filler 130. For example, the more the size and content of the thermal conductive filler 130 increase, the more the heat releasing effect may increase. The body 100 may be manufactured by laminating a plurality of sheets made of the magnetic pulverized material 110 and the insulation material 120 or made of a material including at least one of the metal magnetic powder and the thermal conductive filler 130. Here, when the plurality of sheets are laminated to manufacture the body 100, the thermal conductive fillers 130 of the sheets may have contents different from each other. That is, a content of the thermal conductive filler 130 in at least one region of the body 100 may be different from that of the thermal conductive filler 130 in the other region of the body 100. For example, the more the thermal conductive filler 130 is gradually away upward and downward from the center of the base material 200, the more the content of the thermal conductive filler 130 within the sheet may gradually increase. Also, the body 100 may be manufactured by various methods such as printing of paste, which is made of the magnetic pulverized material 110 and the insulation material 120 or made of a material including at least one of the metal magnetic powder and the thermal conductive filler 130 to a predetermined thickness, or compressing of the paste into a frame. Here, the number of laminated sheet or the thickness of the paste printed to the predetermined thickness so as to form the body 100 may be determined in consideration of electrical characteristics such as an inductance required for the power inductor. The bodies 100*a* and 100*b* disposed on upper and lower portions of the base material 200 with the base material 200 therebetween may be connected to each other through the base material 200. That is, at least a portion of the base material 200 may be removed, and then a portion of the body 100 may be filled into the removed portion of the base material 200. Since at least a portion of the base material 200 is removed, and the body 100 is filled into the removed portion, the base material 200 may be reduced in surface area, and a rate of the body 100 in the same volume may increase to improve the magnetic permeability of the power inductor.

An electromagnetic shielding or absorbing material may be further provided in the body 100. Since the electromagnetic shielding or absorbing material is further provided in the body 100, electromagnetic waves may be shielded or absorbed. The electromagnetic shielding or absorbing material may include ferrite, alumina, and the like. Here, the ferrite may be used as a magnetic material and perform a heat transfer function. That is, the ferrite may improve the magnetic permeability and shield or absorb the electromagnetic waves while performing the heat transfer function. The electromagnetic shielding or absorbing material may be contained to a content of 0.01 wt % to 10 wt % in the body 100. That is, the electromagnetic shielding or absorbing material may be contained to a content of 0.01 wt % to 10 wt % with respect to 100 wt % of the body 100 including the magnetic pulverized material 110 and the insulation material 120 and further including the thermal conductive filler 130 and the metal magnetic powder. Here, when the electromagnetic shielding material in addition to the magnetic pulverized material 110 and the thermal conductive filler 130 is provided, and the ferrite is used as the electromagnetic shielding material, the content thereof may increase. However, when alumina is used, the magnetic permeability may be deteriorated. Thus, a small amount of alumina may be provided. However, if the content is less than 0.01 wt %, the electromagnetic shielding and absorbing characteristics are very little, and thus, it is not advisable. As described above, at least two materials having at least two functions different from each other may be provided in the body 100. That is, the magnetic pulverized material 110 for increasing the magnetic permeability, the thermal conductive filler 130 for releasing the heat within the body 100, and the electromagnetic shielding or absorbing material for shielding or absorbing the electromagnetic waves may be provided. Also, all the improvement of the magnetic permeability and the heat releasing and electromagnetic shielding functions may be performed by using only the ferrite material. However, a plurality of ferrites having compositions different from each other to perform the functions different from each other may be used.

2. Base Material

The base material 200 may be provided in the body 100. For example, the base material 200 may be provided in the body 100 in an X direction of the body 100, i.e., a direction of the external electrode 400. Also, at least one base material 200 may be provided. For example, at least two base materials 200 may be spaced a predetermined distance from each other in a direction perpendicular to a direction in which the external electrode 400 is disposed, i.e., in a vertical direction. Alternatively, at least two base materials 200 may be arranged in the direction in which the external electrode 400 is disposed. For example, the base material 200 may be manufactured by using copper clad lamination (CCL) or a metal magnetic material. Here, the base material 200 may be manufactured by using the metal magnetic material to improve the magnetic permeability and facilitate capacity realization. That is, the CCL is manufactured by bonding copper foil to a glass reinforced fiber. Since the CCL has the magnetic permeability, the power inductor may be deteriorated in magnetic permeability. However, when the metal magnetic material is used as the base material 200, the metal magnetic material may have the magnetic permeability. Thus, the power inductor may not be deteriorated in magnetic permeability. The base material 200 using the metal magnetic material may be manufactured by bonding copper foil to a plate having a predetermined thickness, which is made of a metal containing iron, e.g., at least one metal selected from the group consisting of Fe—Ni, Fe—Ni—Si, Fe—Al—Si, and Fe—Al—Cr. That is, an alloy made of at least one metal containing iron may be manufactured in a plate shape having a predetermined thickness, and copper foil may be bonded to at least one surface of the metal plate to manufacture the base material 200.

Also, at least one conductive via 210 may be formed in a predetermined area of the base material 200. The coil patterns 310 and 320 disposed on the upper and lower portions of the base material 200 may be electrically connected to each other through the conductive via 210. The conductive via may be formed through a method such as the filling of conductive paste into a via (not shown) after forming the via passing through the base material 200 in a thickness direction of the base material 200. Here, at least one of the coil patterns 310 and 320 may be grown from the conductive via 210. Thus, at least one of the coil patterns 310 and 320 may be integrated with the conductive via 210. Also, at least a portion of the base material 200 may be removed. That is, at least a portion of the base material 200 may be removed or may not be removed. As illustrated in FIGS. 3 and 4, an area of the base material 200, which remains except for an area overlapping the coil patterns 310 and 320, may be removed. For example, the base material 200 may be removed to form the through hole 220 inside the coil patterns 310 and 320 each of which has a spiral shape, and the base material 200 outside the coil patterns 310 and 320 may be removed. That is, the base material 200 may have a shape along an outer appearance of each of the coil patterns 310 and 320, e.g., a racetrack shape, and an area of the base material 200 facing the external electrode 400 may have a linear shape along a shape of an end of each of the coil patterns 310 and 320. Thus, the outside of the base material 200 may have a shape that is curved with respect to an edge of the body 100. As illustrated in FIG. 4, the body 100 may be filled into the removed portion of the base material 200. That is, the upper and lower bodies 100*a* and 100*b* may be connected to each other through the removed region including the through hole 220 of the base material 200. When the base material 200 is manufactured using the metal magnetic material, the base material 200 may contact the metal magnetic powder 110 of the body 100. To solve the above-described limitation, the insulation layer 500 such as parylene may be disposed on a side surface of the base material 200. For example, the insulation layer 500 may be disposed on a side surface of the through hole 220 and an outer surface of the base material 200. The base material 200 may have a width greater than that of each of the coil patterns 310 and 320. For example, the base material 200 may remain with a predetermined width in a directly downward direction of the coil patterns 310 and 320. For example, the base material 200 may protrude by a height of approximately 0.3 μm from each of the coil patterns 310 and 320. Since the base material 200 outside and inside the coil patterns 310 and 320 is removed, the base material 200 may have a cross-sectional area less than that of the body 100. For example, when the cross-sectional area of the body 100 is defined as a value of 100, the base material 200 may have an area ratio of 40 to 80. If the area ratio of the base material 200 is high, the magnetic permeability of the body 100 may be reduced. On the other hand, if the area ratio of the base material 200 is low, the formation area of the coil patterns 310 and 320 may be reduced. Thus, the area ratio of the base material 200 may be adjusted in consideration of the magnetic permeability of the body 100 and a line width and turn number of each of the coil patterns 310 and 320.

3. Coil Pattern

The coil pattern 300 (310 and 320) may be disposed on at least one surface, preferably, both side surfaces of the base material 200. Each of the coil patterns 310 and 320 may be formed in a spiral shape on a predetermined area of the base material 200, e.g., outward from a central portion of the base material 200. The two coil patterns 310 and 320 disposed on the base material 200 may be connected to each other to form one coil. That is, each of the coil patterns 310 and 320 may have a spiral shape from the outside of the through hole 220 defined in the central portion of the base material 200. Also, the coil patterns 310 and 320 may be connected to each other through the conductive via 210 provided in the base material 200. Here, the upper coil pattern 310 and the lower coil pattern 320 may have the same shape and the same height. Also, the coil patterns 310 and 320 may overlap each other. Alternatively, the coil pattern 320 may be disposed to overlap an area on which the coil pattern 310 is not disposed. An end of each of the coil patterns 310 and 320 may extend outward in a linear shape and also extend along a central portion of a short side of the body 100. Also, an area of each of the coil patterns 310 and 320 contacting the external electrode 400 may have a width greater than that of the other area as illustrated in FIGS. 3 and 4. Since a portion of each of the coil patterns 310 and 320, i.e., a lead-out part has a relatively wide width, a contact area between each of the coil patterns 310 and 320 and the external electrode 400 may increase to reduce resistance. Alternatively, each of the coil patterns 310 and 320 may extend in a width direction of the external electrode 400 from one area on which the external electrode 400 is disposed. Here, the lead-out part that is led out toward a distal end of each of the coil patterns 310 and 320, i.e., the external electrode 400 may have a linear shape toward a central portion of the side surface of the body 100.

The coil patterns 310 and 320 may be electrically connected to each other by the conductive via 210 provided in the base material 200. The coil patterns 310 and 320 may be formed through methods such as, for example, thick-film printing, coating, deposition, plating, and sputtering. Here, the coil patterns 310 and 320 may preferably formed through the plating. Also, each of the coil patterns 310 and 320 and the conductive via 210 may be made of a material including at least one of silver (Ag), copper (Cu), and a copper alloy, but is not limited thereto. When the coil patterns 310 and 320 are formed through the plating process, a metal layer, e.g., a cupper layer is formed on the base material 200 through the plating process and then patterned through a lithography process. That is, the copper layer may be formed by using the copper foil disposed on the surface of the base material 200 as a seed layer and then patterned to form the coil patterns 310 and 320. Alternatively, a photosensitive pattern having a predetermined shape may be formed on the base material 200, and the plating process may be performed to grow a metal layer from the exposed surface of the base material 200, thereby forming the coil patterns 310 and 320, each of which has a predetermined shape. The coil patterns 310 and 320 may be disposed to form a multilayer structure. That is, a plurality of coil patterns may be further disposed above the coil pattern 310 disposed on the upper portion of the base material 200, and a plurality of coil patterns may be further disposed below the coil pattern 320 disposed on the lower portion of the base material 200. When the coil patterns 310 and 320 have the multilayer structure, the insulation layer may be disposed between a lower layer and an upper layer. Then, the conductive via (not shown) may be formed in the insulation layer to connect the multilayered coil patterns to each other. Each of the coil patterns 310 and 320 may have a height that is greater 2.5 times than a thickness of the base material 200. For example, the base material may have a thickness of 10 μm to 50 μm, and each of the coil patterns 310 and 320 may have a height of 50 μm to 300 μm.

Also, the coil patterns 310 and 320 in accordance with an exemplary embodiment may have a double structure. That is, as illustrated in FIG. 5, a first plated layer 300*a* and a second plated layer 300*b* configured to cover the first plated layer 300*a* may be provided. Here, the second plated layer 300*b* may be disposed to cover top and side surfaces of the first plated layer 300*a*. Also, the second plated layer 300*b* may be formed so that the top surface of the first plated layer

300*a* has a thickness greater than that of the side surface of the first plated layer 300*a*. The side surface of the first plated layer 300*a* may have a predetermined inclination, and a side surface of the second plated layer 300*b* may have an inclination less than that of the side surface of the first plated layer 300*a*. That is, the side surface of the first plated layer 300*a* may have an obtuse angle from the surface of the base material 200 outside the first plated layer 300*a*, and the second plated layer 300*b* has an angle less than that of the first plated layer 300*a*, preferably, a right angle. As illustrated in FIG. 6, a ratio between a width a of a top surface and a width b of a bottom surface of the first plated layer 300*a* may be 0.2:1 to 0.9:1, preferably, 0.4:1 to 0.8:1. Also, a ratio between a width b and a height h of the bottom surface of the first plated layer 300*a* may be 1:0.7 to 1:4, preferably, 1:1 to 1:2. That is, the first plated layer 300*a* may have a width that gradually decreases from the bottom surface to the top surface. Thus, the first plated layer 300*a* may have a predetermined inclination. An etching process may be performed after a primary plating process so that the first plated layer 300*a* has a predetermined inclination. Also, the second plated layer 300*b* configured to cover the first plated layer 300*a* may have an approximately rectangular shape in which a side surface is vertical, and an area rounded between the top surface and the side surface is less. Here, the second plated layer 300*b* may be determined in shape in accordance with a ratio between the width a of the top surface and the width b of the bottom surface of the first plated layer 300*a*, i.e., a ratio of a:b. For example, the more the ratio (a:b) between the width a of the top surface and the width b of the bottom surface of the first plated layer 300*a* increases, the more a ratio between a width c of the top surface and a width d of the bottom surface of the second plated layer 300*b* increases. However, when the ratio (a:b) between the width a of the top surface and the width b of the bottom surface of the first plated layer 300*a* exceeds 0.9:1, the width of the top surface of the second plated layer 300*b* may be more widened than that of the top surface of the second plated layer 300*b*, and the side surface may have an acute angle with respect to the base material 200. Also, when the ratio (a:b) between the width a of the top surface and the width b of the bottom surface of the first plated layer 300*a* is below 0:2:1, the second plated layer 300*b* may be rounded from a predetermined area to the top surface. Thus, the ratio between the top surface and the bottom surface of the first plated layer 300*a* may be adjusted so that the top surface has the wide width and the vertical side surface. Also, a ratio between the width b of the bottom surface of the first plated layer 300*a* and the width d of the bottom surface of the second plated layer 300*b* may be 1:1.2 to 1:2, and a distance between the width b of the bottom surface of the first plated layer 300*a* and the adjacent first plated layer 300*a* may have a ratio of 1.5:1 to 3:1. Alternatively, the second plated layers 300*b* may not contact each other. A ratio (c:d) between the widths of the top and bottom surfaces of the coil patterns 300 constituted by the first and second plated layers 300*a* and 300*b* may be 0.5:1 to 0.9:1, preferably, 0.6:1 to 0.8:1. That is, a ratio between widths of the top and bottom surfaces of an outer appearance of the coil pattern 300, i.e., an outer appearance of the second plated layer 300*b* may be 0.5:1 to 0.9:1. Thus, the coil pattern 300 may have a ratio of 0.5 or less with respect to an ideal rectangular shape in which the rounded area of the edge of the top surface has a right angle. For example, the coil pattern 300 may have a ratio ranging from 0.001 to 0.5 with respect to the ideal rectangular shape in which the rounded area of the edge of the top surface has the right angle. Also, the coil pattern 300 in accordance with an exemplary embodiment may have a relatively low resistance variation when compared to a resistance variation of the ideal rectangular shape. For example, if the coil pattern having the ideal rectangular shape has resistance of 100, resistance the coil pattern 300 may be maintained between values of 101 to 110. That is, the resistance of the coil pattern 300 may be maintained to approximately 101% to approximately 110% in accordance with the shape of the first plated layer 300*a* and the shape of the second plated layer 300*b* that varies in accordance with the shape of the first plated layer 300*a* when compared to the resistance of the ideal coil pattern having the rectangular shape. The second plated layer 300*b* may be formed by using the same plating solution as the first plated layer 300*a*. For example, the first and second plated layers 300*a* and 300*b* may be formed by using a plating solution that is based on copper sulfate and sulfuric acid. Here, the plating solution may be improved in plating property of a product by adding chlorine (Cl) having a ppm unit and an organic compound. The organic compound may be improved in uniformity and throwing power of the plated layer and gloss characteristics by using a carrier and a polish.

Also, the coil pattern 300 may be formed by laminating at least two plated layers. Here, each of the plated layers may have a vertical side surface and be laminated in the same shape and at the same thickness. That is, the coil pattern 300 may be formed on a seed layer through a plating process. For example, three plated layers may be laminated on the seed layer to form the coil pattern 300. The coil pattern 300 may be formed through an anisotropic plating process and have an aspect ratio of approximately 2 to approximately 10.

Also, the coil pattern 300 may have a shape of which a width gradually increases from the innermost circumference to the outermost circumference thereof. That is, the coil pattern 300 having the spiral shape may include n patterns from the innermost circumference to the outermost circumference. For example, when four patterns are provided, the patterns may have widths that gradually increase in order of a first pattern that is disposed on the innermost circumference, a second pattern, a third pattern, and a fourth pattern that is disposed on the outermost circumference. For example, when the width of the first pattern is 1, the second pattern may have a ratio of 1 to 1.5, the third pattern may have a ratio of 1.2 to 1.7, and the fourth pattern may have a ratio of 1.3 to 2. That is, the first to fourth patterns may have a ratio of 1:1 to 1.5:1.2 to 1.7:1.3 to 2. That is, the second pattern may have a width equal to or greater than that of the first pattern, the third pattern may have a width greater than that of the first pattern and equal to or greater than that of the second pattern, and the fourth pattern may have a width greater than that of each of the first and second patterns and equal to or greater than that of the third pattern. The seed layer may have a width that gradually increases from the innermost circumference to the outermost circumference so that the coil pattern has the width that gradually increases from the innermost circumference to the outermost circumference. Also, widths of at least one region of the coil pattern in a vertical direction may be different from each other. That is, a lower end, an intermediate end, and an upper end of the at least one region may have widths different from each other.

4. External Electrode

The external electrodes 410 and 420 (400) may be disposed on two surface facing each other of the body 100. For example, the external electrodes 410 and 420 may be disposed on two side surfaces of the body 100, which face each other in the X direction. The external electrodes 410 and 420 may be electrically connected to the coil patterns 310 and 320 of the body 100, respectively. Also, the external electrodes 410 and 420 may be disposed on the two side surfaces of the body 100 to contact the coil patterns 310 and 320 at central portions of the two side surfaces, respectively. That is, an end of each of the coil patterns 310 and 320 may be exposed to the outer central portion of the body 100, and the external electrode 400 may be disposed on the side surface of the body 100 and then connected to the end of each of the coil patterns 310 and 320. The external electrode 400 may be formed by using conductive paste. That is, both side surfaces of the body 100 may be immersed into the conductive paste, or the conductive paste may be printed on both side surfaces of the body 100 to form the external electrode 400. Also, the external electrode 400 may be formed through various methods such as deposition, sputtering, and plating. The external electrode 400 may be formed on both side surfaces and only the bottom surface of the body 100. Alternatively, the external electrode 400 may be formed on the top surface or front and rear surfaces of the body 100. For example, when the body 100 is immersed into the conductive paste, the external electrode 400 may be formed on both side surfaces in the X direction, the front and rear surfaces in the Y direction, and the top and bottom surfaces in the Z direction. On the other hand, when the external electrode 400 is formed through the methods such as the printing, the deposition, the sputtering, and the plating, the external electrode 400 may be formed on both side surfaces in the X direction and the bottom surface in the Y direction. That is, the external electrode 400 may be formed on other areas in accordance with the formation method or process conditions as well as both side surfaces in the X direction and the bottom surface on which a printed circuit board is mounted. The external electrode 400 may be made of a metal having electrical conductivity, e.g., at least one metal selected from the group consisting of gold, silver, platinum, copper, nickel, palladium, and an alloy thereof. Here, at least a portion of the external electrode 400 connected to the coil pattern 300, i.e., a portion of the external electrode 400 connected to the coil pattern 300 disposed on the surface of the body 100 may be formed of the same material as the coil pattern 300. For example, when the coil pattern 300 is formed by using copper through the plating process, at least a portion of the external electrode 400 may be formed by using copper. Here, as described above, the copper may be deposited or printed through the immersion or printing method using the conductive paste or may be deposited, printed, or plated through the methods such as the deposition, sputtering, and plating. Preferably, the external electrode 400 may be formed through the plating. The seed layer is formed on both side surfaces of the body 100 so that the external electrode 400 is formed through the plating process, and then, the plated layer may be formed from the seed layer to form the external electrode 400. Here, at least a portion of the external electrode 400 connected to the coil pattern 300 may be the entire side surface or a portion of the body 100 on which the external electrode 400 is disposed. The external electrode 400 may further include at least one plated layer. That is, the external electrode 400 may include a first layer connected to the coil pattern 300 and at least plated layer disposed on a top surface of the first layer. For example, the external electrode 400 may further include a nickel-plated layer (not shown) and a tin-plated layer (not shown). That is, the external electrode 400 may have a laminated structure of a copper layer, an Ni-plated layer, and an Sn-plated layer or a laminated structure of a copper layer, an Ni-plated layer, and an Sn/Ag-plated layer. Here, the plated layer may be formed through electrolytic plating or electroless plating. The Sn-plated layer may have a thickness equal to or greater than that of the N-plated layer. For example, the external electrode 400 may have a thickness of 2 μm to 100 μm. Here, the Ni-plated layer may have a thickness of 1 μm to 10 μm, and the Sn or Sn/Ag-plated layer may have a thickness of 2 μm to 10 μm. Also, the external electrode 400 may be formed by mixing, for example, multicomponent glass frit using $Bi_2O_3$ or $SiO_2$ of 0.5% to 20% as a main component with metal powder. Here, the mixture of the glass frit and the metal powder may be manufactured in the form of paste and applied to the two surface of the body 100. That is, when a portion of the external electrode 400 is formed by using the conductive paste, the glass frit may be mixed with the conductive paste. As described above, since the glass frit is contained in the external electrode 400, adhesion force between the external electrode 400 and the body 100 may be improved, and a contact reaction between the coil pattern 300 and the external electrode 400 may be improved.

5. Insulation Layer

The insulation layer 500 may be disposed between the coil patterns 310 and 320 and the body 100 to insulate the coil patterns 310 and 320 from the metal magnetic powder 110. That is, the insulation layer 500 may cover the top and side surfaces of each of the coil patterns 310 and 320. Here, the insulation layer 500 may be formed on the top and side surfaces of each of the coil patterns 310 and 320 at substantially the same thickness. For example, the insulation layer 500 may have a thickness ratio of 1 to 1.2:1 at the top and side surfaces of each of the coil patterns 310 and 320. That is, each of the coil patterns 310 and 320 may have the top surface having a thickness greater by 20% than that of the side surface. Preferably, the top and side surfaces may have the same thickness. Also, the insulation layer 500 may cover the base material 200 as well as the top and side surfaces of each of the coil patterns 310 and 320. That is, the insulation layer 500 may be formed on an exposed area than the coil patterns 310 and 320 of the base material 200 of which a predetermined region is removed, i.e., a surface and side surface of the base material 200. The insulation layer 500 on the base material 200 may have the same thickness as the insulation layer 500 on each of the coil patterns 310 and 320. That is, the insulation layer 500 on the top surface of the base material 200 may have the same thickness as the insulation layer 500 on the top surface of each of the coil patterns 310 and 320, and the insulation layer 500 on the side surface of the base material 200 may have the same thickness as the insulation layer 500 on the side surface of each of the coil patterns 310 and 320. The insulation layer 500 may be formed by applying the parylene on the coil patterns 310 and 320. For example, the base material 200 on which the coil patterns 310 and 320 are formed may be provided in a deposition chamber, and then, the parylene may be evaporated and supplied into the vacuum chamber to deposit the parylene on the coil patterns 310 and 320. For example, the parylene may be primarily heated and evaporated in a vaporizer to become a dimer state and then be secondarily heated and pyrolyzed into a monomer state. Then, when the parylene is cooled by using a cold trap connected to the deposition chamber and a mechanical vacuum pump, the parylene may be converted from the monomer state to a polymer state and thus be deposited on the coil patterns 310 and 320. Alternatively, the insulation layer 500 may be formed of an insulation polymer in addition to the parylene, for example, at least one material selected from epoxy, polyimide, and liquid crystal crystalline polymer. However, the parylene may be applied to form the insulation layer 500 having the uniform thickness on the coil patterns 310 and 320. Also, although the insulation layer 500 has a thin thickness, the insulation property may be improved when compared to other materials. That is, when the insulation layer 500 is coated with the parylene, the insulation layer 500 may have a relatively thin thickness and improved insulation property by increasing a breakdown voltage when compared to a case in which the insulation layer 500 is made of the polyimide. Also, the parylene may be filled between the coil patterns 310 and 320 at the uniform thickness along a gap between the patterns or formed at the uniform thickness along a stepped portion of each of the patterns. That is, when a distance between the patterns of the coil patterns 310 and 320 is far, the parylene may be applied at the uniform thickness along the stepped portion of the pattern. On the other hand, the distance between the patterns is near, the gap between the patterns may be filled to form the parylene at a predetermined thickness on the coil patterns 310 and 320. FIG. 7 is a cross-sectional image of the power inductor in which the insulation layer is formed by using the polyimide, and FIG. 8 is a cross-sectional image of the power inductor in which the insulation layer is formed by using the parylene. As illustrated in FIG. 8, in case of the parylene, although the parylene has a relatively thin thickness along the stepped portion of each of the coil patterns 310 and 320, the polyimide may have a thickness greater than that of the parylene as illustrated in FIG. 7. The insulation layer 500 may have a thickness of 3 μm to 100 μm by using the parylene. When the parylene is formed to a thickness of 3 μm or less, the insulation property may be deteriorated. When the parylene is formed to a thickness exceeding 100 μm, the thickness occupied by the insulation layer 500 within the same size may increase to reduce a volume of the body 100, and thus, the magnetic permeability may be deteriorated. Alternatively, the insulation layer 500 may be manufactured in the form of a sheet having a predetermined thickness and then formed on the coil patterns 310 and 320.

6. Surface Modification Member

A surface modification member (not shown) may be formed on at least one surface of the body 100. The surface modification member may be formed by dispersing oxide onto the surface of the body 100 before the external electrode 400 is formed. Here, the oxide may be dispersed and distributed onto the surface of the body 100 in a crystalline state or an amorphous state. The surface modification member may be distributed on the surface of the body 100 before the plating process when the external electrode 400 is formed through the plating process. That is, the surface modification member may be distributed before the printing process is performed on a portion of the external electrode 400 or be distributed before the plating process is performed after the printing process is performed. Alternatively, when the printing process is not performed, the plating process may be performed after the surface modification member is distributed. Here, at least a portion of the surface modification member distributed on the surface may be melted.

At least a portion of the surface modification member may be uniformly distributed on the surface of the body with the same size, and at least a portion may be non-uniformly distributed with sizes different from each other. Also, a concave part may be formed in a surface of at least a portion of the body 100. That is, the surface modification member may be formed to form a convex part. Also, at least a portion of an area on which the surface modification member is not formed may be recessed to form the concave part. Here, at least a portion of the surface modification member may be recessed from the surface of the body 100. That is, a portion of the surface modification member, which has a predetermined thickness, may be inserted into the body 100 by a predetermined depth, and the rest portion of the surface modification member may protrude from the surface of the body 100. Here, the portion of the surface modification member, which is inserted into the body 100 by the predetermined depth, may have a diameter corresponding to 1/20 to 1 of a mean diameter of oxide particles. That is, all the oxide particles may be impregnated into the body 100, or at least a portion of the oxide particles may be impregnated. Alternatively, the oxide particles may be formed on only the surface of the body 100. Thus, each of the oxide particles may be formed in a hemispherical shape on the surface of the body 100 and in a globular shape. Also, as described above, the surface modification member may be partially distributed on the surface of the body or distributed in the form of a film on at least one area of the body 100. That is, the oxide particles may be distributed in the form of an island on the surface of the body 100 to form the surface modification member. That is, the oxide particles having the crystalline state or the amorphous state may be spaced apart from each other on the surface of the body 100 and distributed in the form of the island. Thus, at least a portion of the surface of the body 100 may be exposed. Also, at least two oxide particles may be connected to each other to form the film on at least one area of the surface of the body 100 and the island shape on at least a portion of the surface of the body 100. That is, at least two oxide particles may be aggregated, or the oxide particles adjacent to each other may be connected to each other to form the film. However, although the oxide exists in the particle state, or at least two particles are aggregated with or connected to each other, at least a portion of the surface of the body 100 may be exposed to the outside by the surface modification member.

Here, the total area of the surface modification member may correspond to 5% to 90% of the entire area of the surface of the body 100. Although a plating blurring phenomenon on the surface of the body 100 is controlled in accordance with the surface area of the surface modification member, if the surface modification member is widely formed, the contact between the conductive pattern and the external electrode 400 may be difficult. That is, when the surface modification member is formed on an area of 5% or less of the surface area of the body 100, it may be difficult to control the plating blurring phenomenon. When the surface modification member is formed on an area exceeding 90%, the conductive pattern may not contact the external electrode 400. Thus, it is preferable that a sufficient area on which the plating blurring phenomenon of the surface modification member is controlled, and the conductive pattern contacts the external electrode 400 is formed. For this, the surface modification member may be formed with a surface area of 10% to 90%, preferably, 30% to 70%, more preferably, 40% to 50%. Here, the surface area of the body 100 may be a surface area of one surface thereof or a surface area of six surfaces of the body 100, which define a hexahedral shape. The surface modification member may have a thickness of 10% or less of the thickness of the body 100. That is, the surface modification member may have a thickness of 0.01% to 10% of the thickness of the body 100. For example, the surface modification member may have a size of 0.1 μm to 50 μm. Thus, the surface modification member may have a thickness of 0.1 μm to 50 μm from the surface of the body 100. That is, the surface modification member may have a thickness of 0.1% to 50% of the thickness of the body 100 except for the portion inserted from the surface of the body 100. Thus, the surface modification member may have a thickness greater than that of 0.1 μm to 50 μm when the thickness of the portion inserted into the body 100 is added. That is, when the surface modification member has a thickness of 0.01% or less of the thickness of the body 100, it may be difficult to control the plating blurring phenomenon. When the surface modification member has a thickness exceeding 10%, the conductive pattern within the body 100 may not contact the external electrode 400. That is, the surface modification member may have various thicknesses in accordance with material properties (conductivity, semiconductor properties, insulation, magnetic materials, and the like) of the body 100. Also, the surface modification member may have various thicknesses in accordance with sizes, distributed amount, whether the aggregation occurs, and the like) of the oxide powder.

Since the surface modification member is formed on the surface of the body 100, two areas, which are mode of components different from each other, of the surface of the body 100 may be provided. That is, components different from each other may be detected from the area on which the surface modification member is formed and the area on which the surface modification member is not formed. For example, a component due to the surface modification member, i.e., oxide may exist on the area on which the surface modification member is formed, and a component due to the body 100, i.e., a component of the sheet may exist on the area on which the surface modification member is not formed. Since the surface modification member is distributed on the surface of the body before the plating process, roughness may be given to the surface of the body 100 to modify the surface of the body 100. Thus, the plating process may be uniformly performed, and thus, the shape of the external electrode 400 may be controlled. That is, resistance on at least an area of the surface of the body 100 may be different from that on the other area of the surface of the body 100. When the plating process is performed in a state in which the resistance is non-uniform, ununiformity in growth of the plated layer may occur. To solve this limitation, the oxide that is in a particle state or melted state may be dispersed on the surface of the body 100 to form the surface modification member, thereby modifying the surface of the body 100 and controlling the growth of the plated layer.

Here, at least one oxide may be used as the oxide, which is in the particle or melted state, for realizing the uniform surface resistance of the body 100. For example, at least one of $Bi_2O_3$, $BO_2$, $B_2O_3$, ZnO, $Co_3O_4$, $SiO_2$, $Al_2O_3$, MnO, $H_2BO_3$, $Ca(CO_3)_2$, $Ca(NO_3)_2$, and $CaCO_3$ may be used as the oxide. The surface modification member may be formed on at least one sheet within the body 100. That is, the conductive pattern having various shapes on the sheet may be formed through the plating process. Here, the surface modification member may be formed to control the shape of the conductive pattern.

7. Insulation Capping Layer

As illustrated in FIG. 9, an insulation capping layer 550 may be disposed on the top surface of the body 100 on which the external electrode 400 is disposed. That is, the insulation capping layer may be disposed on the top surface facing the bottom surface of the body 100 mounted on a printed circuit board (PCB), e.g., the top surface of the body 100 in the Z direction. The insulation capping layer 550 may be provided to prevent the external electrode 400 disposed on the top surface of the body 100 to extend from being short-circuited with a shield can or a circuit component disposed above the external electrode 400. That is, in the power inductor, the external electrode 400 disposed on the bottom surface of the body 100 may be adjacent to a power management IC (PMIC) and mounted on the printed circuit board. The PMIC may have a thickness of approximately 1 mm, and the power inductor may also have the same thickness as the PMIC. The PMIC may generate high frequency noises to affect surrounding circuits or devices. Thus, the PMIC and the power inductor may be covered by the shield can that is made of a metal material, e.g., a stainless steel material. However, the power inductor may be short-circuited with the shield can because the external electrode is also disposed thereabove. Thus, the insulation capping layer 500 may be disposed on the top surface of the body 100 to prevent the power inductor from being short-circuited with an external conductor. Here, since the insulation capping layer 550 is provided to insulate the external electrode 400, which is disposed on the top surface of the body 100 to extend, from the shield can, the insulation capping layer 550 may cover the external electrode 400 disposed on the top surface of at least the body 100. The insulation capping layer 550 is made of an insulation material. For example, the insulation capping layer 550 may be made of at least one selected from the group consisting of epoxy, polyimide, and liquid crystalline polymer (LCP). Also, the insulation capping layer 550 may be made of a thermosetting resin. For example, the thermosetting resin may include at least one selected from the group consisting of a novolac epoxy resin, a phenoxy type epoxy resin, a BPA type epoxy resin), a BPF type epoxy resin), a hydrogenated BPA epoxy resin), a dimer acid modified epoxy resin, an urethane modified epoxy resin), a rubber modified epoxy resin, and a DCPD type epoxy resin. That is, the insulation capping layer 550 may be made of a material that is used for the insulation layer 120 of the body 100. The insulation capping layer may be formed by immersing the top surface of the body 100 into the insulation material such as the polymer or the thermosetting resin. Thus, as illustrated in FIG. 7, the insulation capping layer 550 may be disposed on a portion of each of both side surfaces in the X direction of the body 100 and a portion of each of the front and rear surfaces in the Y direction as well as the top surface of the body 100. The insulation capping layer 550 may be made of parylene. Alternatively, the insulation capping layer 550 may be made of various insulation materials such as $SiO_2$, $Si_3N_4$, and SiON. When the insulation capping layer 500 is made of the above-described materials, the insulation capping layer 500 may be formed through methods such as CVD and PVD. If the insulation capping layer 500 is formed through the CVD or PVD, the insulation capping layer 550 may be formed on only the top surface of the body 100, i.e., on only the top surface of the external electrode 400 disposed on the top surface of the body 100. The insulation capping layer 550 may have a thickness that is enough to prevent the external electrode 400 disposed on the top surface of the body 100 from being short-circuited with the shield can, e.g., a thickness of 10 μm to 100 μm. Also, the insulation capping layer 550 may be formed at the uniform thickness on the top surface of the body 100 so that a stepped portion is maintained between the external electrode 400 and the body 100. Alternatively, the insulation capping layer 550 may have a thickness on the top surface of the body, which is thicker than that of the top surface of the external electrode 400, and thus be planarized to remove the stepped portion between the external electrode 400 and the body 100. Alternatively, the insulation capping layer 550 may be manufactured with a predetermined thickness and then be adhered to the body 100 by using an adhesive.

As described above, in the power inductor in accordance with an exemplary embodiment, the body 100 may be manufactured by using the magnetic pulverized material 110 and the insulation material 120 to improve the magnetic permeability of the body 100. That is, since the body 100 is manufactured by using the magnetic pulverized material 110 formed by pulverizing a magnetic molded product having magnetic permeability greater than that of the metal magnetic powder, the body 100 may be improved in magnetic permeability. Also, a more amount of thermal conductive filler may be contained in the body 100 to improve the thermal stability, and the magnetic pulverized material 110 and the metal magnetic powder may be mixed with each other to form the body 100, thereby improving the withstanding voltage characteristics. Also, since the insulation layer 500 is formed between the coil patterns 310 and 320 and the body 100 by using the parylene, the insulation layer 500 may be formed with a thin thickness on the side surface and the top surface of each of the coil patterns 310 and 320 to improve the insulation property. Also, since the base material 200 within the body 100 is made of the metal magnetic material, the decreases of the magnetic permeability of the power inductor may be prevented. Also, at least a portion of the base material 200 may be removed, and the body 100 may be filled into the removed portion to improve the magnetic permeability. Also, since the insulation capping layer 550 is formed on the top surface of the body 100 on which the external electrode 400 is formed, the short circuit between the external electrode 400, the shield can, and adjacent components may be prevented.

Experimental Example

A magnetic permeability and a quality factor (hereinafter, referred to as a Q factor) depending on adding of a magnetic pulverized material were measured. For this, a body was manufactured by using metal magnetic powder and a polymer. In an exemplary embodiment, the body was manufactured by using the metal magnetic powder, the magnetic pulverized material, and the polymer. First to third metal magnetic powder which respectively have mean particle size distributions D50 of 53 μm, 8 μm, and 3 μm were mixed with each other at a ratio of 8:1:1. That is, the first, second, and third metal magnetic powder were respectively mixed at contents of 80 wt %, 10 wt %, and 10 wt % with respect to 100 wt % of the total metal magnetic powder. Also, a material including Fe, Si, and Cr was used as the metal magnetic powder. Also, a body in accordance with the comparison example was manufactured by containing 4.25 wt % of epoxy with respect to 100 wt % of the metal magnetic powder.

Also, 0.5 wt % of the magnetic pulverized material was mixed with a mixture of the metal magnetic power in accordance with an exemplary embodiment. That is, 0.5 wt % of the magnetic pulverized material was mixed with 100 wt % of the mixture of the first to third metal magnetic power and the magnetic pulverized material. Also, the material including Fe, Si, and Cr was used as the magnetic pulverized material. Here, the magnetic pulverized material having a mean particle size distribution D50 of 3 μm was used. Also, a body in accordance with an exemplary embodiment was manufactured by containing 4.25 wt % of epoxy with respect to 100 wt % of the metal magnetic powder and the magnetic pulverized material. Here, three bodies manufactured under the same condition were used for measuring in embodiments.

Figure 10:
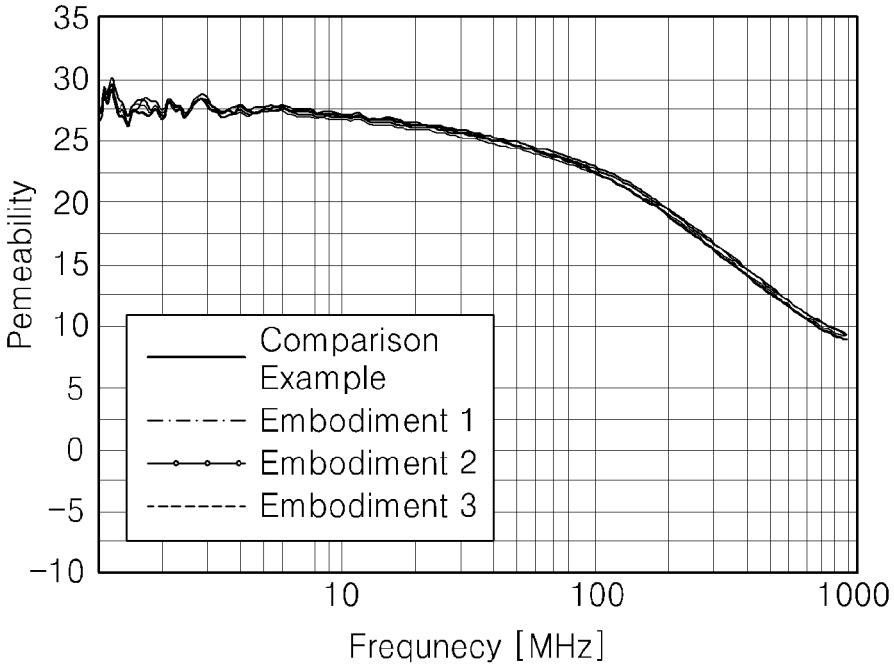
FIGS. 10 and 11 are graphs illustrating magnetic permeability and Q factors in accordance with a comparison example and an exemplary embodiment.
Figure 11:
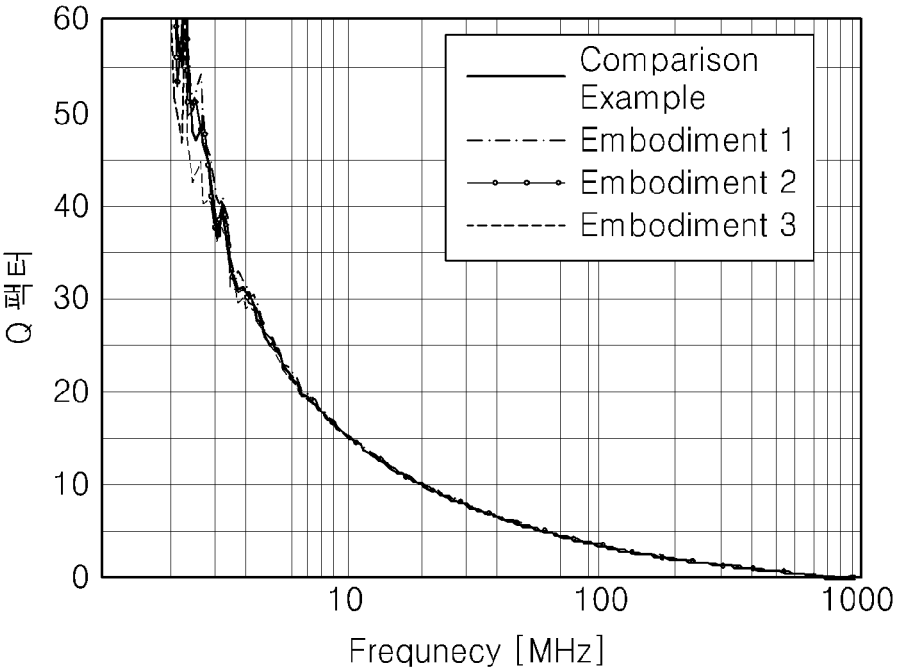

The magnetic permeability in accordance with the comparison example and the embodiments were illustrated in FIG. 10, and the Q factors were illustrated in FIG. 11. Also, the magnetic permeability and the Q factors at frequencies of 3 MHz and 5 MHz in accordance with the comparison example and the embodiments were shown in Table 1.

TABLE 1

| | Magnetic permeability | | Q factor | |
|---|---|---|---|---|
| | 3 MHz | 5 MHz | 3 MHz | 5 MHz |
| Comparison Example | 27.6 | 27.0 | 42.2 | 25.0 |
| Embodiment 1 | 27.7 | 27.4 | 44.3 | 25.9 |
| Embodiment 2 | 28.0 | 27.9 | 40.3 | 25.7 |
| Embodiment 3 | 27.4 | 27.3 | 39.8 | 25.0 |

As described above, it is seen that the magnetic permeability and the Q factors in accordance with the embodiments are almost similar to each other. That is, it is seen that the magnetic permeability and the Q factors when a small amount of magnetic pulverized material is added are almost similar to those when the magnetic pulverized material is not added.

Figure 12:
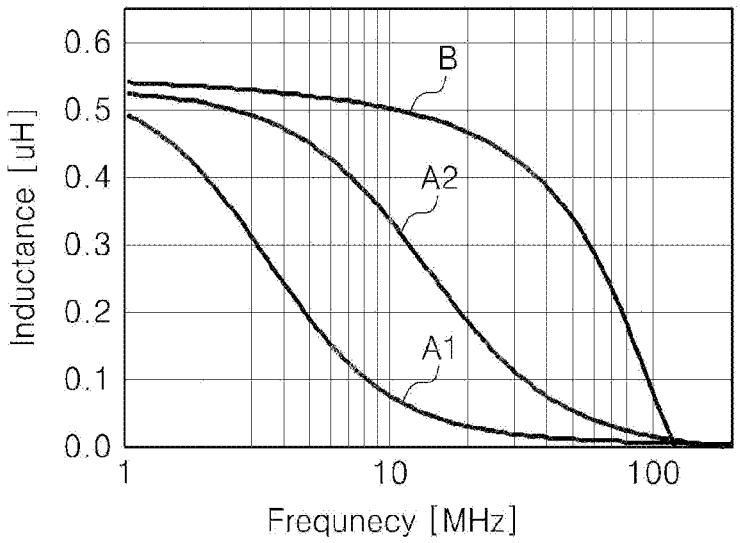
FIG. 12 is a graph illustrating withstanding voltage characteristics in accordance with a comparison example and an exemplary embodiment.

FIG. 12 is a graph illustrating withstanding voltage characteristics in accordance with a comparison example and an exemplary embodiment. That is, graphs A1 and A2 show withstanding voltage characteristics in accordance with the comparison example, and a graph B shows withstanding voltage characteristics in accordance with an exemplary embodiment. When an ESD voltage of ±200V is repeatedly applied five times so as to compare the withstanding voltage characteristics, a frequency and an inductance in accordance with the applied ESD voltage are illustrated in FIG. 12. As illustrated in FIG. 12, it is seen that the inductance is significantly reduced in accordance with the applying of the ESD voltage in the comparison example, and the inductance is maintained as it is at frequencies of 3 MHz and 5 MHz in accordance with the applying of the ESD voltage in the exemplary embodiment. That is, an inductance of 0.5 μH is maintained at the frequencies of 3 MHz and 5 MHz in the exemplary embodiment. Thus, it is seen that a small amount of magnetic pulverized material is added to improve the withstanding voltage characteristics.

Various Embodiments and Modified Example

Figure 13:
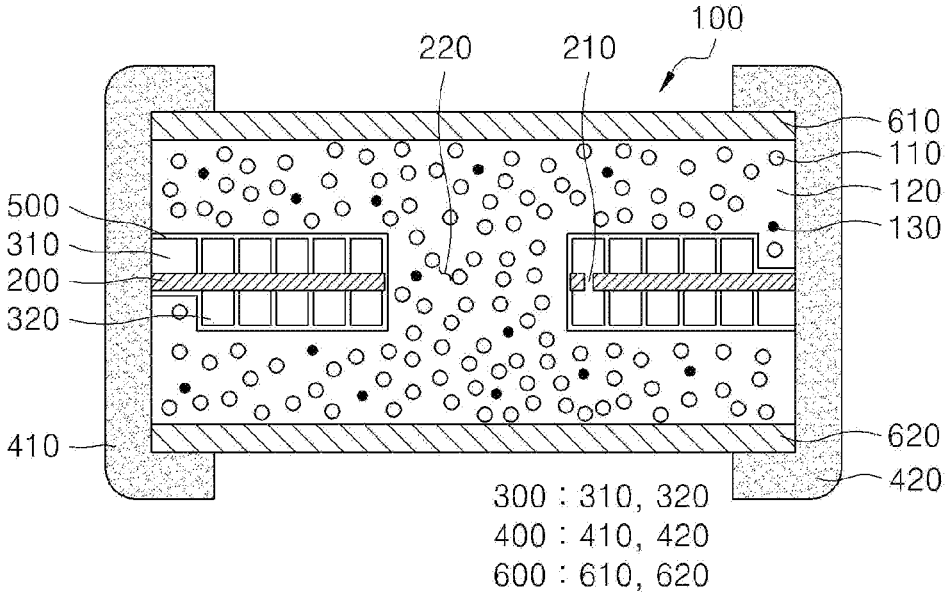
FIGS. 13 to 20 are cross-sectional views of a power inductor in accordance with another exemplary embodiment.

FIG. 13 is a perspective view of a power inductor in accordance with still another exemplary embodiment.

Referring to FIG. 13, a power inductor in accordance with another exemplary embodiment may include a body 100, a base material 200 provided in the body 100, coil patterns 310 and 320 disposed on at least one surface of the base material 200, external electrodes 410 and 420 provided outside the body 100, an insulation layer 500 provided on each of the coil patterns 310 and 320, and at least one magnetic layer 600 (610, 620) provided on each of top and bottom surfaces of the body 100. That is, another exemplary embodiment may be realized by further providing the magnetic layer 600 in an exemplary embodiment. Also, the body 100 may be formed by mixing a magnetic pulverized material and an insulation material 120, mixing metal magnetic powder and the insulation material 120, or mixing the magnetic pulverized material 110, the metal magnetic powder, and the insulation material 120. Here, a thermal conductive filler 130 may be further provided to form the body 100. Hereinafter, constitutions different from those in accordance with an exemplary embodiment will be mainly described in accordance with another exemplary embodiment.

The magnetic layer 600 (610, 620) may be disposed on at least one area of the body 100. That is, a first magnetic layer 610 may be disposed on the top surface of the body 100, and the second magnetic layer 620 may be disposed on the bottom surface of the body 100. Here, the magnetic layer 600 may be provided to improve magnetic permeability of the body 100. Thus, the magnetic layer 600 may be made of a material having magnetic permeability grater than that of the body 100. For example, the body 100 including the magnetic pulverized material 110 may have magnetic permeability of 50, and the first and second magnetic layers 610 and 620 may have magnetic permeability of 60 to 1000. That is, the magnetic layer 600 may have magnetic permeability greater by 1.1 times than that of the body 100. The magnetic layer 600 may be formed by using at least one of the magnetic pulverized material and the metal magnetic powder and the insulation material. That is, the magnetic layer 600 may be formed by mixing at least one of the magnetic pulverized material and the metal magnetic powder with the insulation material. For example, in case of using the magnetic pulverized material, the magnetic powder may be ball-milled and pulverized, and then a binder is put to mold a predetermined body. Then, the predetermined body may be compressed and de-bound and then sintered to manufacture a magnetic sintered body. Then, the manufactured magnetic sintered body may be pulverized to a predetermined size to manufacture the magnetic pulverized material 110. The manufactured magnetic pulverized material may be mixed with the insulation material to form the magnetic layer 600. Also, the magnetic layer 600 may be formed by using the magnetic sintered body or an amorphous metal ribbon. That is, the magnetic sintered body having a plate shape with a predetermined thickness or the metal ribbon without mixing the insulation material may be used as the magnetic layer 600. To form the metal ribbon made of an amorphous alloy, a melted metal of the alloy may be injected into a cooling wheel that rotates at a high speed to form the metal ribbon. That is, since the molten metal is injected into the cooling wheel, the molten metal may be quickly cooled, for example, from a temperature of 1600 degrees to a predetermined temperature, e.g., a temperature of about several hundreds degrees per second, and thus, the magnetic layer 600 may be formed into an amorphous state. The magnetic layer 600 may have various widths and thicknesses. For example, the magnetic layer 110 may have various thicknesses in accordance with a rotating rate of the cooling wheel and various widths in accordance with a width of the cooling width. The amorphous magnetic layer 600 may be used by being cut to match the size of the body 100. Also, at least two magnetic layers 600 may be disposed on the same plane, i.e., the same layer. When the magnetic layer 600 is formed by using the magnetic sintered body or the metal ribbon, at least a portion of the magnetic layer 600 may not contact an external electrode 400. That is, when one side of the magnetic layer 600 contacts a first external electrode 410, the other side of the magnetic layer 110 may be spaced apart from a second external electrode 420. When the one side and the other side of the magnetic layer 110 contact the first and second external electrodes 410 and 420, one area of the magnetic layer 110 may be spaced apart from the first and second external electrodes 410 and 420. Thus, the two external electrodes 400 are not electrically connected to each other by the magnetic layer 600.

The magnetic layer 600 may be formed of the same material or component as the magnetic pulverized material 110 to form the body 100. For example, the magnetic layer 600 may be formed by using an alloy to which Si, B, Nb, Cu, and the like are added on the basis of Fe. When the magnetic layer 600 is formed by using the magnetic pulverized material, the magnetic layer 600 may be formed of a material having a magnetic property greater than that of the magnetic pulverized material 110 of the body 100 or formed with a higher content of the magnetic pulverized material so that the magnetic layer 600 has magnetic permeability greater than that of the body 100. For example, 5.0 wt % of the insulation material with respect to 2.0 wt % of the magnetic pulverized material may be added to the magnetic layer 600. The magnetic layer 600 may further include at least one of the metal magnetic powder and the thermal conductive filler in addition to the magnetic pulverized material. Here, the metal magnetic power may be coated with the magnetic material or the insulation material. The metal magnetic power and the thermal conductive filler may have a content of 0.5 wt % to 3 wt % with respect to 100 wt % of the magnetic pulverized material. The magnetic layer 600 may be manufactured in the form of a sheet and disposed on each of the top and bottom surfaces of the body 100 on which the plurality of sheets are laminated. Also, paste made of a material including the magnetic pulverized material and the insulation material may be printed to a predetermined thickness or may be put into a frame and compressed to form the body 100, thereby forming the first and second magnetic layers 610 and 620 on the top and bottom surfaces of the body 100. Alternatively, the magnetic layer 600 may be formed by using paste. That is, a magnetic material may be applied to the top and bottom surfaces of the body 100 to form the first and second magnetic layers 610 and 620.

Figure 14:
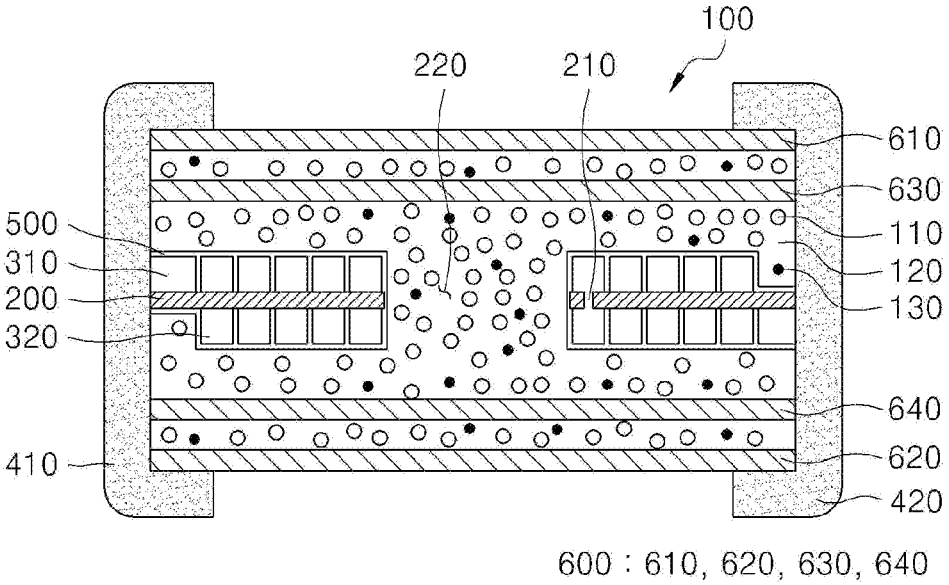

In the power inductor in accordance with another exemplary embodiment, third and fourth magnetic layers 630 and 640 may be further provided between the first and second magnetic layers 610 and 620 and the base material 200 as illustrated in FIG. 14. That is, at least one magnetic layer 600 may be provided in the body 100. The magnetic layer 600 may be manufactured in the form of the sheet and disposed in the body 100 on which the plurality of sheets are laminated. That is, at least one magnetic layer 600 may be provided between the plurality of sheets for manufacturing the body 100.

Figure 15:
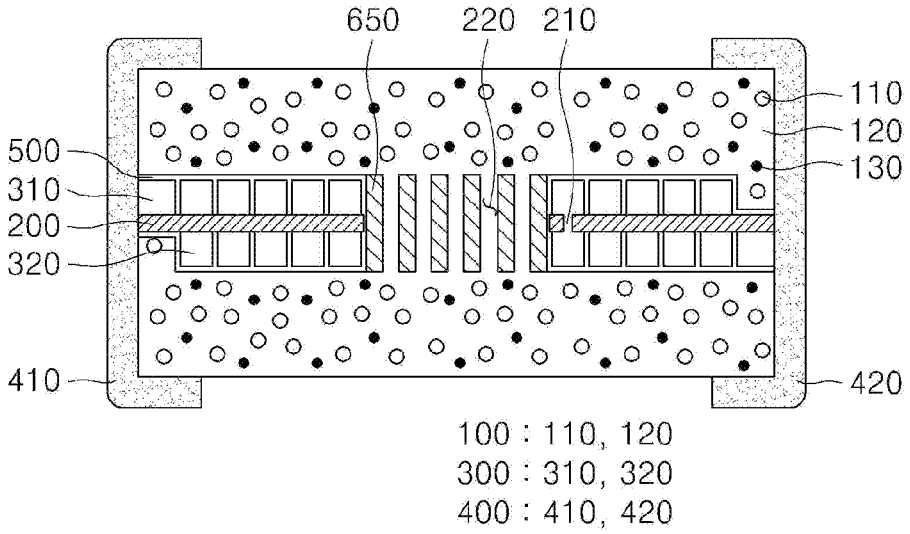
Figure 16:
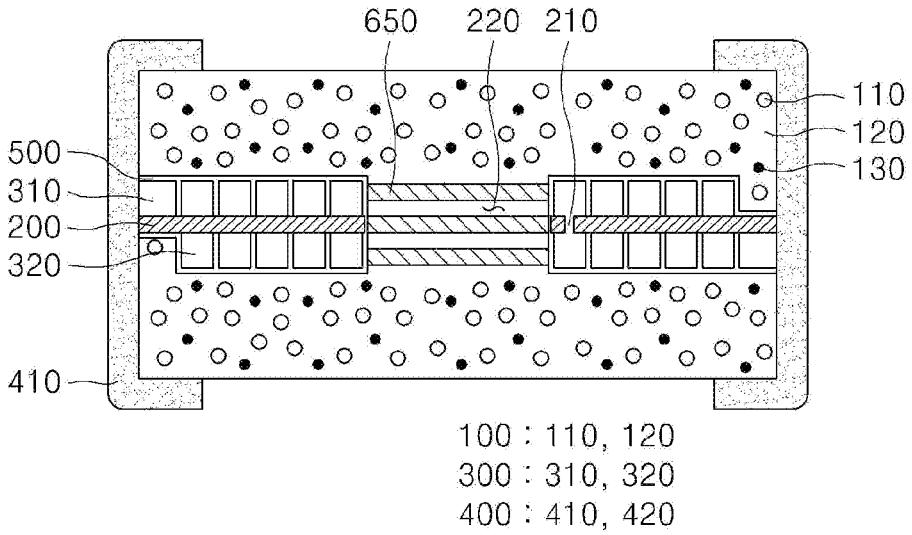

Also, in the power inductor in accordance with another exemplary embodiment, at least one fifth magnetic layer 650 may be provided in a through hole 220 formed in a central portion of the base material 200 in a direction perpendicular to the base material 200 as illustrated in FIG. 15. Also, as illustrated in FIG. 16, the at least one fifth magnetic layer 650 may be formed in the through hole 220 formed in the central portion of the base material 200 in a direction parallel to the base material 200. That is, although the at least one magnetic layer 600 is formed in each of the upper and lower sides of the base material 200 in the horizontal direction in FIGS. 13 and 14, the at least one fifth magnetic layer 650 may be formed in the through hole 220 in the vertical or horizontal direction as illustrated in FIGS. 15 and 16. Here, the insulation material 120 is formed between the magnetic layers 650. That is, the plurality of fifth magnetic layers 650 and insulation materials 120 may be alternately formed in the through hole 220.

Figure 17:
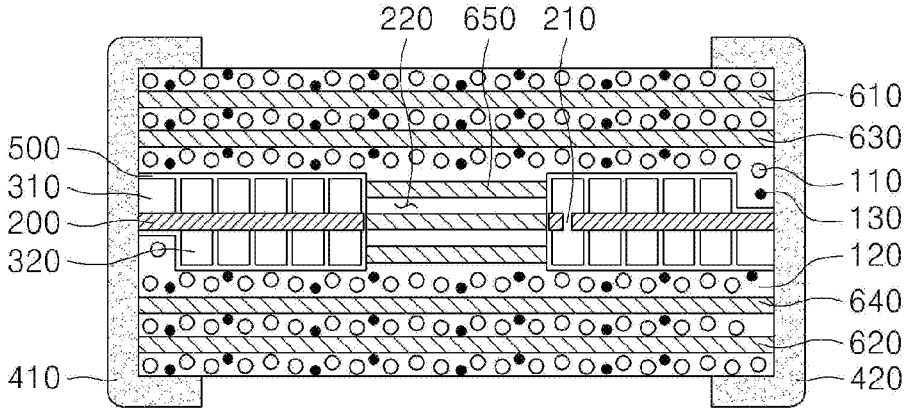
Figure 18:
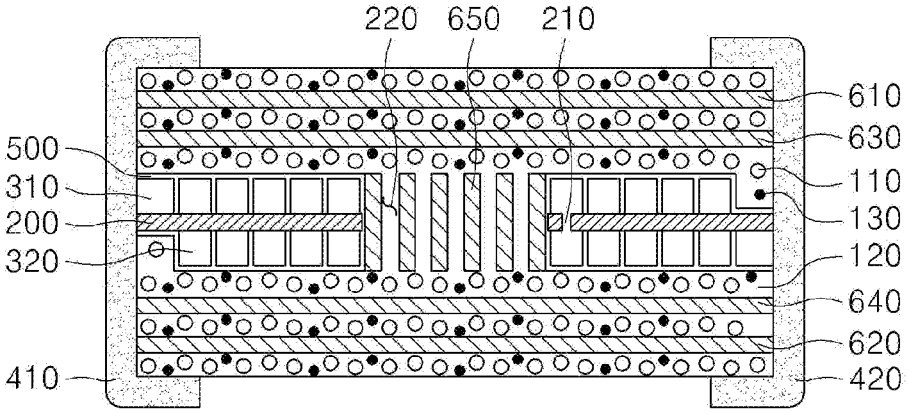

Also, as illustrated in FIG. 17, the at least one fifth magnetic layer 600 (610, 620, 630, 640) may be formed in the body 100, and the fifth magnetic layer 650 may be further formed in the through hole 220 formed in the central portion of the base material 200 in the direction parallel to the base material 200. Also, as illustrated in FIG. 18, the at least one fifth magnetic layer 600 (610, 620, 630, 640) may be formed in the body 100, and the fifth magnetic layer 650 may be further formed in the through hole 220 formed in the central portion of the base material 200 in the direction perpendicular to the base material 200. That is, although the magnetic layer 600 is formed in each of the upper and lower sides of the base material 200 in the horizontal direction in FIGS. 13 and 14, the fifth magnetic layer 650 may be formed in the through hole 220 in the vertical or horizontal direction as illustrated in FIGS. 17 and 18.

Figure 19:
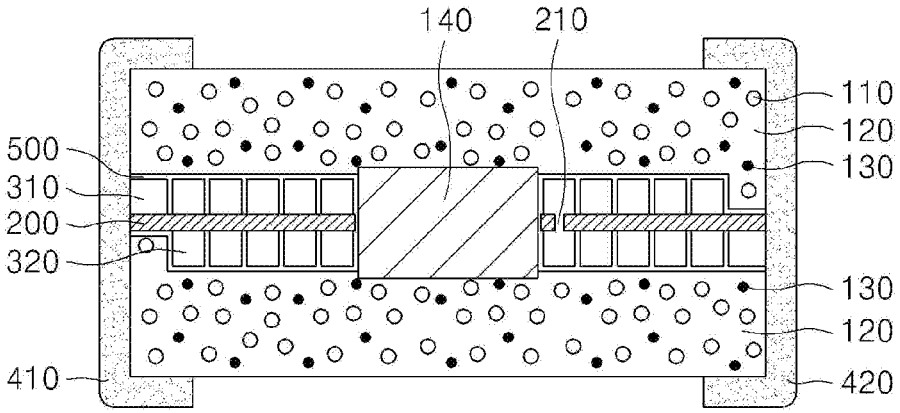
Figure 20:
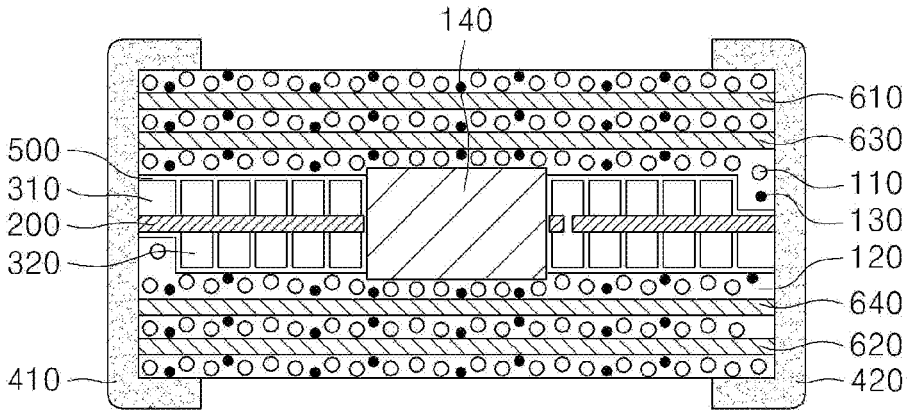

Also, the magnetic material 140 may be filled into the through hole 220 of the base material 200. Here, the body 100 may be formed by mixing the magnetic pulverized material 110 with the insulation material 120 as illustrated in FIG. 19, and at least one magnetic layer 600 may be further formed as illustrated in FIG. 20. Here, the magnetic material 140 may be formed of the same material as the magnetic layer 600. For example, a plurality of metal ribbons may be laminated to form the magnetic material 140, and then, the magnetic material 140 may be filled into the through hole 220 of the body 100 to form the magnetic material 140. Thus, the magnetic material 140 may have magnetic permeability different from that of the magnetic pulverized material 110 and also have magnetic permeability equal to or different from that of the magnetic layer 600. For example, the magnetic material 140 may be formed of a material and have a composition, which are different from the magnetic pulverized material 110 and the magnetic layer 600, or may have the same material or composition as the magnetic layer 600. Here, preferably, the magnetic material 140 may have magnetic permeability greater than that of the magnetic pulverized material 110. That is, the magnetic material 140 may have the magnetic permeability greater than that of the magnetic pulverized material 110 to improve the entire magnetic permeability of the power inductor. The magnetic material 140 may include at least one of FeSiAl-based sendust ribbon or powder, FeSiBCr-base amorphous ribbon or powder, FeSiBCr-based crystalline ribbon or powder, FeSiCr-based ribbon or powder, and FeSiCrBCuNb-based ribbon or powder. Here, the ribbon may have a plate shape having a predetermined thickness. Also, the magnetic material 140 may have a shape in which the ribbon or powder are aggregated. Alternatively, the magnetic material 140 may be formed by laminating the ribbon on the insulation layer or by mixing the metal magnetic powder with the insulation material.

As described above, in the power inductor in accordance another exemplary embodiment, the at least one magnetic layer 600 may be provided in the body 100 to improve the magnetic permeability of the power inductor.

Figure 21:
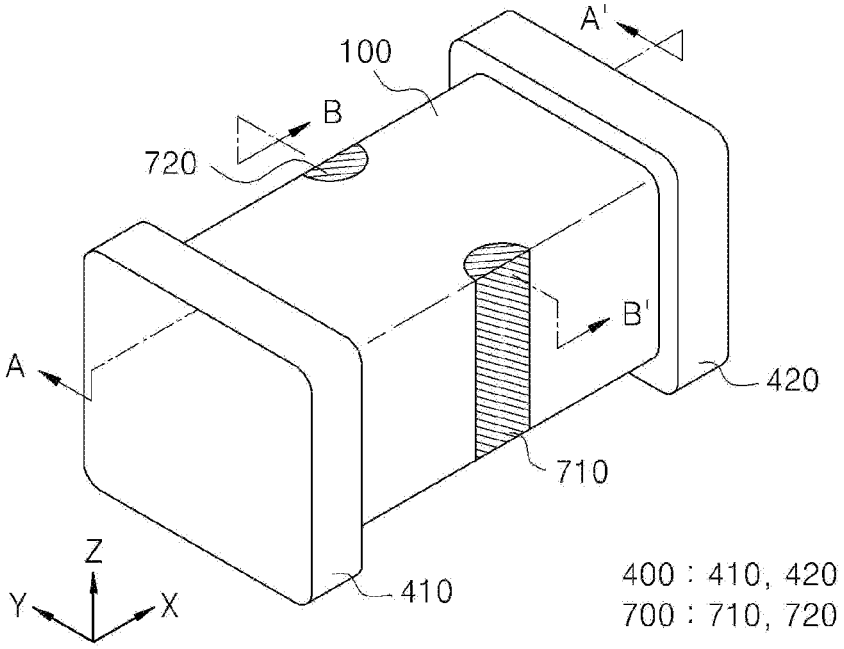
FIG. 21 is a perspective view of a power inductor in accordance with further another exemplary embodiment.
Figure 22:
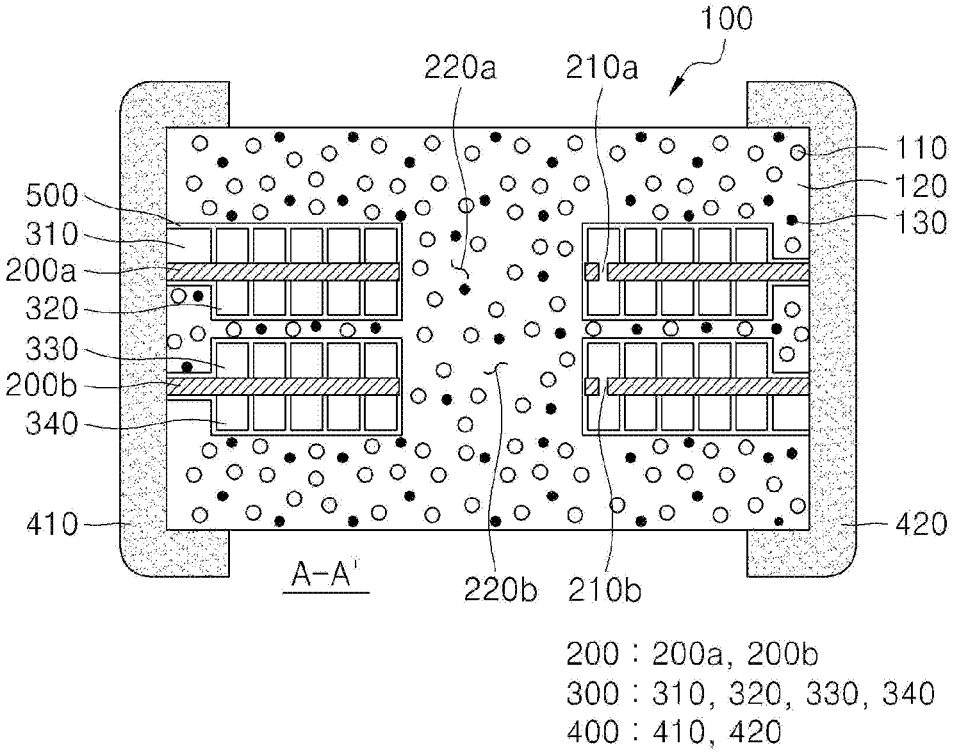
FIGS. 22 and 23 are cross-sectional views taken along lines A-A' and B-B' of FIG. 21.
Figure 23:
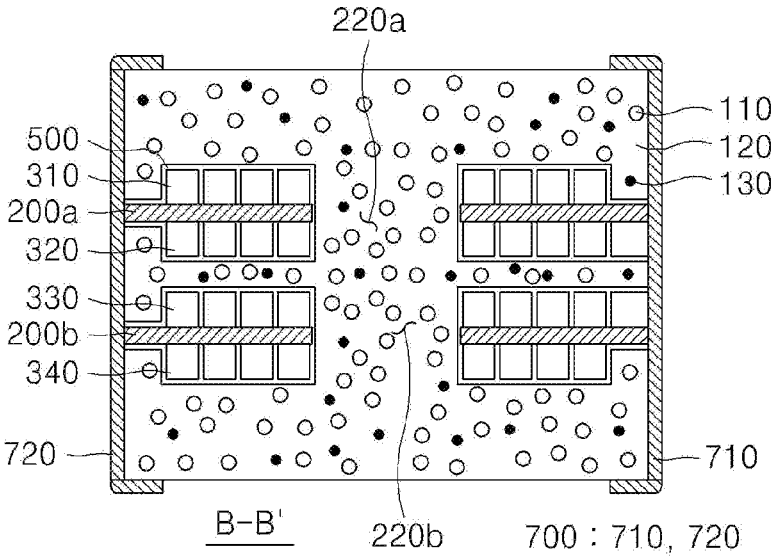

FIG. 21 is a perspective view of a power inductor in accordance with further another exemplary embodiment, FIG. 22 is a cross-sectional view taken along line A-A' of FIG. 21, and FIG. 23 is a cross-sectional view taken along line B-B' of FIG. 21.

Referring to FIGS. 21 to 23, a power inductor in accordance with further another exemplary embodiment may include a body 100, at least two base materials 200*a* and 200*b* (200) provided in the body 100, coil patterns 310, 320, 330, and 340 (300) disposed on at least one surface of each of the at least two base materials 200, external electrodes 410 and 420 disposed outside the body 100, an insulation layer 500 disposed on the coil patterns 500, and connection electrodes 710 and 720 (700) spaced apart from the external electrodes 410 and 420 outside the body 100 and connected to at least one coil pattern 300 disposed on each of at least two substrates 300 within the body 100. Hereinafter, descriptions duplicated with those in accordance to the foregoing exemplary embodiments will be omitted.

The at least two base materials 200*a* and 200*b* (200) may be provided in the body 100 and spaced a predetermined distance from each other a short axial direction of the body 100. That is, the at least two base materials 200 may be spaced a predetermined distance from each other in a direction perpendicular to the external electrode 400, i.e., in a thickness direction of the body 100. Also, conductive vias 210*a* and 210*b* (210) may be formed in the at least two base materials 200, respectively. Here, at least a portion of each of the at least two base materials 200 may be removed to form each of through holes 220*a* and 220*b* (220). Here, the through holes 220*a* and 220*b* may be formed in the same position, and the conductive vias 210*a* and 210*b* may be formed in the same position or positions different from each other. Alternatively, an area of the at least two base materials 200, in which the through holes 220 and the coil patterns 300 are not provided, may be removed, and then, the body 100 may be filled. The body 100 may be disposed between the at least two base materials 200. The body 100 may be disposed between the at least two base materials 200 to improve magnetic permeability of the power inductor. Alternatively, since the insulation layer 500 is disposed on the coil pattern 300 disposed on the at least two base materials 200, the body 100 may not be provided between the base materials 200. In this case, the power inductor may be reduced in thickness.

The coil patterns 310, 320, 330, and 340 (300) may be disposed on at least one surface of each of the at least two base materials 200, preferably, both surfaces of each of the at least two base materials 200. Here, the coil patterns 310 and 320 may be disposed on lower and upper portions of a first substrate 200*a* and electrically connected to each other by the conductive via 210*a* provided in the first base material 200*a*. Similarly, the coil patterns 330 and 340 may be disposed on lower and upper portions of a second substrate 200*b* and electrically connected to each other by the conductive via 210*b* provided in the second base material 200*b*. Each of the plurality of coil patterns 300 may be formed in a spiral shape on a predetermined area of the base material 200, e.g., outward from the through holes 220*a* and 220*b* in a central portion of the base material 200. The two coil patterns 310 and 320 disposed on the base material 200 may be connected to each other to form one coil. That is, at least two coils may be provided in one body 100. Here, the upper coil patterns 310 and 330 and the lower coil patterns 320 and 340 of the base material 200 may have the same shape. Also, the plurality of coil patterns 300 may overlap each other. Alternatively, the lower coil patterns 320 and 340 may be disposed to overlap an area on which the upper coil patterns 310 and 330 are not disposed.

The external electrodes 410 and 420 (400) may be disposed on both ends of the body 100. For example, the external electrodes 400 may be disposed on two side surfaces of the body 100, which face each other in a longitudinal direction. The external electrode 400 may be electrically connected to the coil patterns 300 of the body 100. That is, at least one end of each of the plurality of coil patterns 300 may be exposed to the outside of the body 100, and the external electrode 400 may be connected to the end of each of the plurality of coil patterns 300. For example, the external electrode 410 may be connected to the coil pattern 310, and the external pattern 420 may be connected to the coil pattern 340. That is, the external electrodes 400 may be respectively connected to the coil patterns 310 and 340 disposed on the base materials 200*a* and 200*b*.

The connection electrode 700 may be disposed on at least one side surface of the body 100, on which the external electrode 400 is not provided. For example, the external electrode 400 may be disposed on each of first and second side surfaces facing each other, and the connection electrode 700 may be disposed on each of third and fourth side surfaces on which the external electrode 400 is not provided. The connection electrode 700 may be provided to connect at least one of the coil patterns 310 and 320 disposed on the first base material 200*a* to at least one of the coil patterns 330 and 340 disposed on the second base material 200*b*. That is, the connection electrode 710 may connect the coil pattern 320 disposed below the first base material 200*a* to the coil pattern 330 disposed above the second base material 200*b* at the outside of the body 100. That is, the external electrode 410 may be connected to the coil pattern 310, the connection electrode 710 may connect the coil patterns 320 and 330 to each other, and the external electrode 420 may be connected to the coil pattern 340. Thus, the coil patterns 310, 320, 330, and 340 disposed on the first and second base materials 200*a* and 200*b* may be connected to each other in series. Although the connection electrode 710 connects the coil patterns 320 and 330 to each other, the connection electrode 720 may not be connected to the coil patterns 300. This is done because, for convenience of processes, two connection electrodes 710 and 720 are provided, and only one connection electrode 710 is connected to the coil patterns 320 and 330. The connection electrode 700 may be formed by immersing the body 100 into conductive paste or formed on one side surface of the body 100 through various methods such as printing, deposition, and sputtering. The connection electrode 700 may include a metal have electrical conductivity, e.g., at least one metal selected from the group consisting of gold, silver, platinum, copper, nickel, palladium, and an alloy thereof. Here, a nickel-plated layer (not show) and a tin-plated layer (not shown) may be further disposed on a surface of the connection electrode 700.

Figure 24:
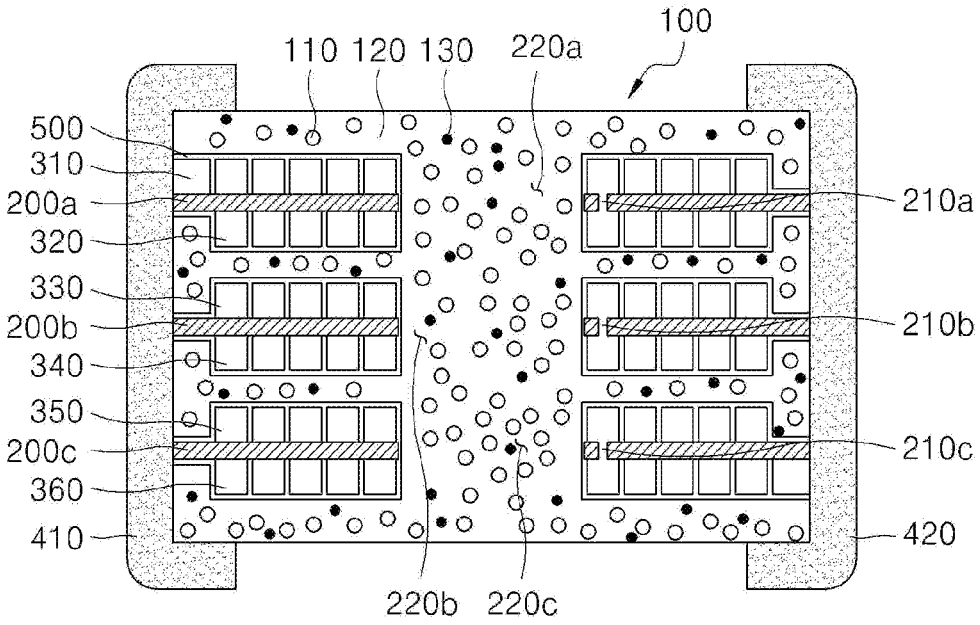
FIGS. 24 and 25 are cross-sectional views taken along lines A-A' and B-B' of FIG. 18 in accordance with a modified example of the further another embodiment.
Figure 25:
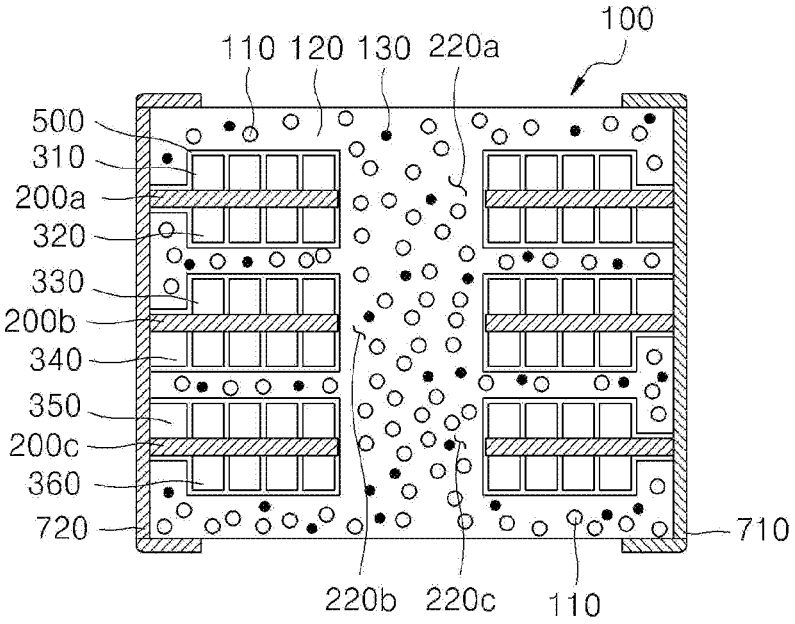

FIGS. 24 and 25 are cross-sectional views illustrating a modified example of a power inductor in accordance with further another exemplary embodiment. That is, three base materials 200*a*, 200*b*, and 200*c* (200) may be provided in the body 100, coil patterns 310, 320, 330, 340, 350, and 360 (300) may be disposed on one surface and the other surface of each of the base materials 200, the coil patterns 310 and 360 may be connected to external electrodes 410 and 420, and coil patterns 320 and 330 may be connected to a connection electrode 710, and the coil patterns 340 and 350 may be connected to a connection electrode 720. Thus, the coil patterns 300 respectively disposed on the three base materials 200*a*, 200*b*, and 200*c* may be connected to each other in series by the connection electrodes 710 and 720.

As described above, in the power inductor in accordance with further another exemplary embodiment and the modified example, the at least two base materials 200 on which each of the coil patterns 300 is disposed on at least one surface may be spaced apart from each other within the body 100, and the coil pattern 300 disposed on the other base material 200 may be connected by the connection electrode 700 outside the body 100. As a result, the plurality of coil patterns may be provided within one body 100, and thus, the power inductor may increase in capacity. That is, the coil patterns 300 respectively disposed on the base materials 200 different from each other may be connected to each other in series by using the connection electrode 700 outside the body 100, and thus, the power inductor may increase in capacity on the same area.

Figure 26:
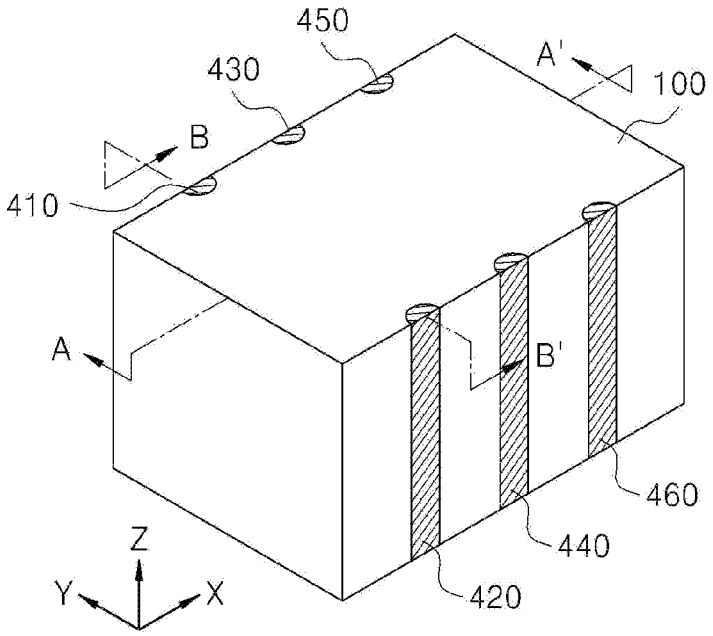
FIG. 26 is a perspective view of a power inductor in accordance with still another exemplary embodiment.
Figure 27:
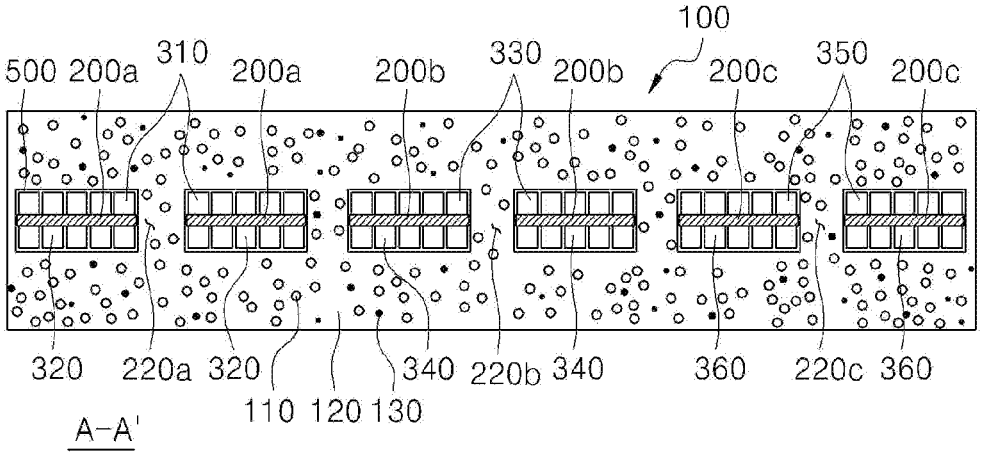
FIGS. 27 and 28 are cross-sectional views taken along lines A-A' and B-B' of FIG. 26.
Figure 28:
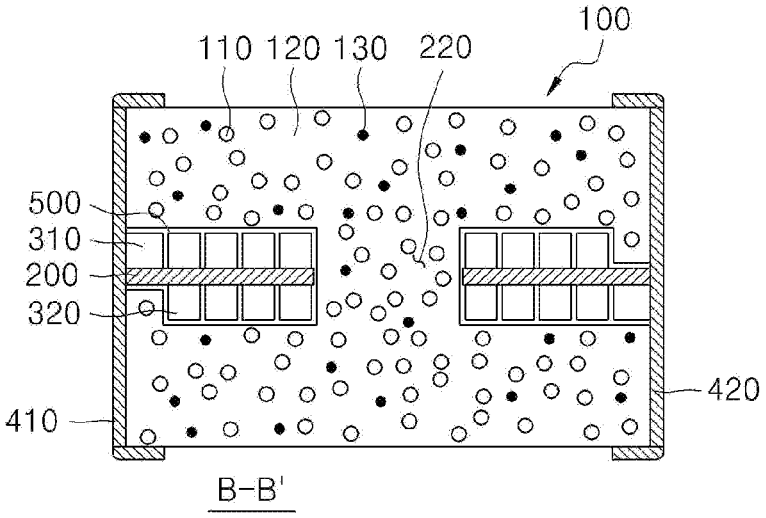
Figure 29:
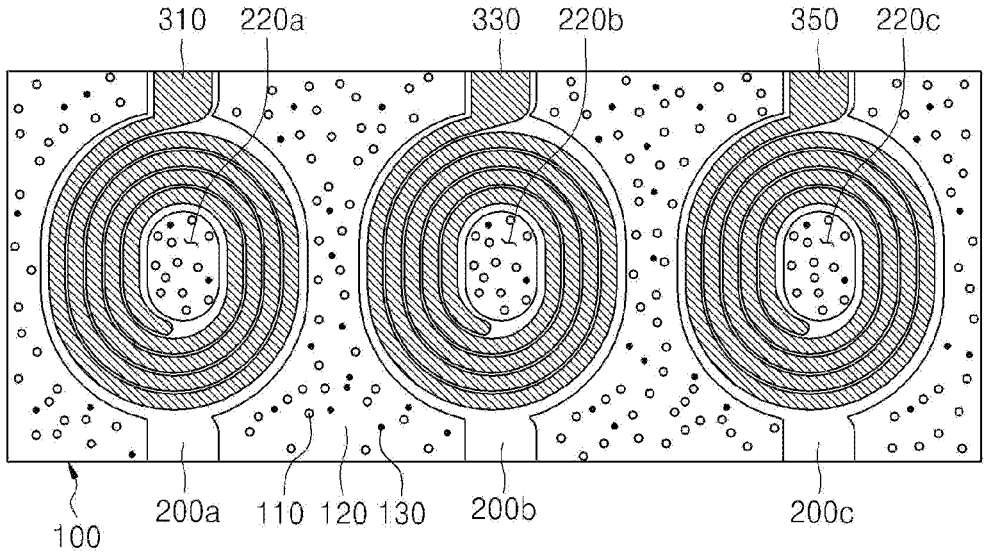
FIG. 29 is an internal plan view of FIG. 26.

FIG. 26 is a perspective view of a power inductor in accordance with still another exemplary embodiment, and FIGS. 27 and 28 are cross-sectional views taken along lines A-A' and B-B' of FIG. 26. Also, FIG. 29 is an internal plan view.

Referring to FIGS. 26 to 29, a power inductor in accordance with further another exemplary embodiment may include a body 100, at least two base materials 200*a*, 200*b*, and 200*c* (200) provided in the body 100 in a horizontal direction, coil patterns 310, 320, 330, 340, 350, and 360 (300) disposed on at least one surface of each of the at least two base materials 200, external electrodes 410, 420, 430, 440, 450, and 460 disposed outside the body 100 and disposed on the at least two base materials 200*a*, 200*b*, and 200*c*, and an insulation layer 500 disposed on the coil patterns 300. Hereinafter, descriptions duplicated with the foregoing embodiments will be omitted.

At least two, e.g., three base materials 200*a*, 200*b*, and 200*c* (200) may be provided in the body 100. Here, the at least two base materials 200 may be spaced a predetermined distance from each other in a longitudinal direction that is perpendicular to a thickness direction of the body 100. That is, in the further another exemplary embodiment and the modified example, the plurality of base materials 200 are arranged in the thickness direction of the body 100, e.g., in a vertical direction. However, in the current embodiment, the plurality of base materials 200 may be arranged in a direction perpendicular to the thickness direction of the body 100, e.g., a horizontal direction. Also, conductive vias 210*a*, 210*b*, and 210*c* (210) may be formed in the plurality of base materials 200, respectively. Here, at least a portion of each of the plurality of base materials 200 may be removed to form each of through holes 220*a*, 220*b*, and 220*c* (220). Alternatively, an area of the plurality of base materials 200, in which the through holes 220 and the coil patterns 300 are not provided, may be removed as illustrated in FIG. 20, and then, the body 100 may be filled.

The coil patterns 310, 320, 330, 340, 350, and 360 (300) may be disposed on at least one surface of each of the plurality of base materials 200, preferably, both surfaces of each of the plurality of base materials 200. Here, the coil patterns 310 and 320 may be disposed on one surface and the other surface of a first substrate 200*a* and electrically connected to each other by the conductive via 210*a* provided in the first base material 200*a*. Also, the coil patterns 330 and 340 may be disposed on one surface and the other surface of a second substrate 200*b* and electrically connected to each other by the conductive via 210*b* provided in the second base material 200*b*. Similarly, the coil patterns 350 and 360 may be disposed on one surface and the other surface of a third substrate 200*c* and electrically connected to each other by the conductive via 210*c* provided in the third base material 200*c*. Each of the plurality of coil patterns 300 may be formed in a spiral shape on a predetermined area of the base material 200, e.g., outward from the through holes 220*a*, 220*b*, and 200*c* in a central portion of the base material 200. The two coil patterns 310 and 320 disposed on the base material 200 may be connected to each other to form one coil. That is, at least two coils may be provided in one body 100. Here, the coil patterns 310, 330, and 350 that are disposed on one side of the base material 200 and the coil patterns 320, 340, and 360 that are disposed on the other side of the base material 200 may have the same shape. Also, the coil patterns 300 may overlap each other on the same base material 200. Alternatively, the coil patterns 320, 330, and 350 that are disposed on the one side of the base material 200 may be disposed to overlap an area on which the coil patterns 320, 340, and 360 that are disposed on the other side of the base material 200 are not disposed.

The external electrodes 410, 420, 430, 440, 450, and 460 (400) may be spaced apart from each other on both ends of the body 100. The external electrode 400 may be electrically connected to the coil patterns 300 respectively disposed on the plurality of base materials 200. For example, the external electrodes 410 and 420 may be respectively connected to the coil patterns 310 and 320, the external electrode 430 and 440 may be respectively connected to the coil patterns 330 and 340, and the external electrodes 450 and 460 may be respectively connected to the coil patterns 350 and 360. That is, the external electrodes 400 may be respectively connected to the coil patterns 300 and 340 disposed on the base materials 200*a*, 200*b*, and 200*c*.

As described above, in the power inductor in accordance with further another exemplary embodiment, the plurality of inductors may be realized in one body 100. That is, the at least two base materials 200 may be arranged in the horizontal direction, and the coil patterns 300 respectively disposed on the base materials 200 may be connected to each other by the external electrodes different from each other. Thus, the plurality of inductors may be disposed in parallel, and at least two power inductors may be provided in one body 100.

Figure 30:
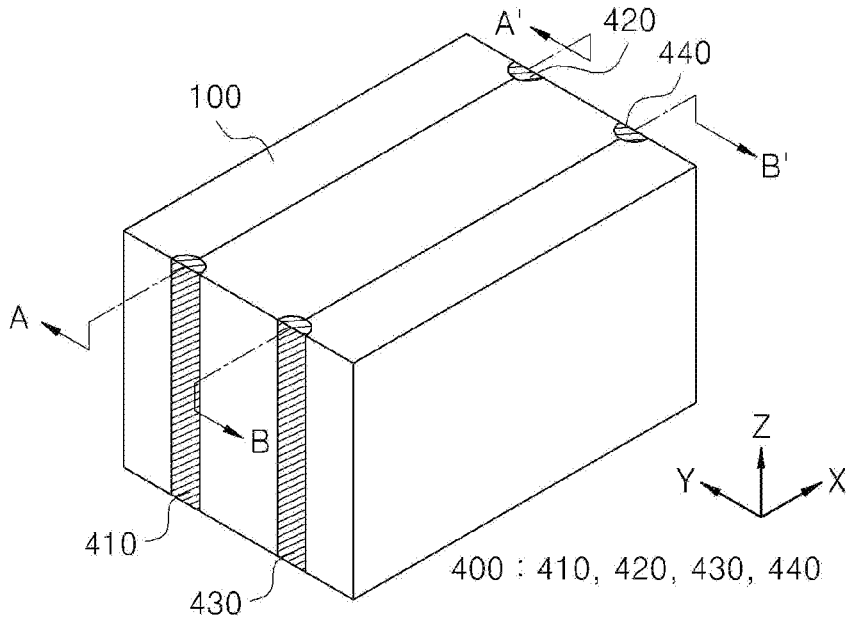
FIG. 30 is a perspective view of a power inductor in accordance with even another exemplary embodiment.
Figure 31:
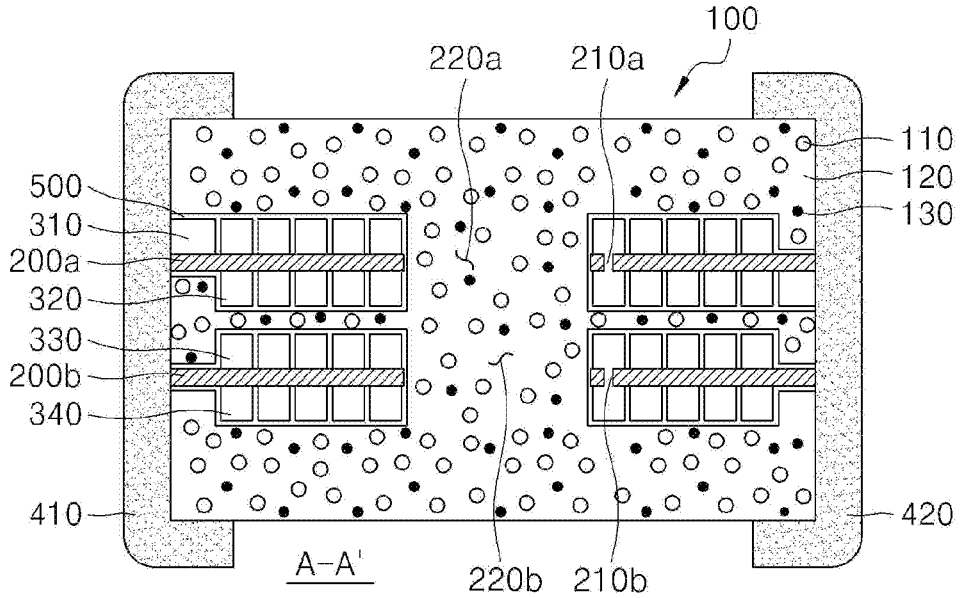
FIGS. 31 and 32 are cross-sectional views taken along lines A-A' and B-B' of FIG. 30.
Figure 32:
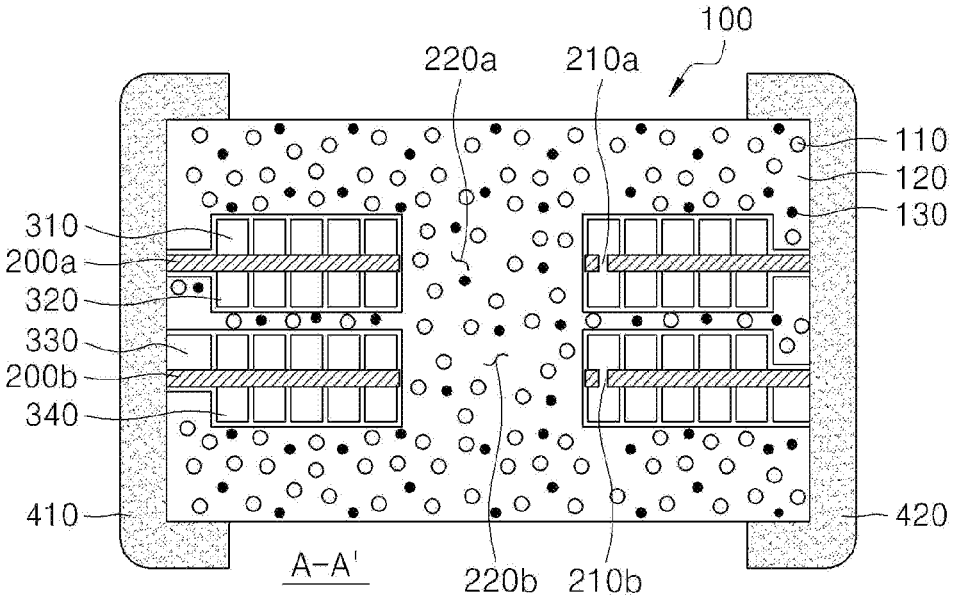

FIG. 30 is a perspective view of a power inductor in accordance with even another exemplary embodiment, and FIGS. 31 and 32 are cross-sectional views taken along lines A-A' and B-B' of FIG. 30.

Referring to FIGS. 30 to 32, a power inductor in accordance with further another exemplary embodiment may include a body 100, at least two base materials 200*a* and 200*b* 200*c* (200) provided in the body 100, coil patterns 310, 320, 330, and 340 (300) disposed on at least one surface of each of the at least two base materials 200, and a plurality of external electrodes 410, 420, 430, and 440 disposed on two side surfaces facing of the body 100 and respectively connected to the coil patterns 310, 320, 330, and 340 disposed on the base materials 200*a* and 200*b*. Here, the at least two base materials 200 may be spaced a predetermined distance from each other and laminated in a thickness direction of the body 100, i.e., in a vertical direction, and the coil patterns 300 disposed on the base materials 200 may be withdrawn in directions different from each other and respectively connected to the external electrodes. That is, in accordance with the foregoing exemplary embodiment, the plurality of base materials 200 may be arranged in the horizontal direction. However, in accordance with the current embodiment, the plurality of base materials may be arranged in the vertical direction. Thus, in the current embodiment, the at least two base materials 200 may be arranged in the thickness direction of the body 100, and the coil patterns 300 respectively disposed on the base materials 200 may be connected to each other by the external electrodes different from each other. Thus, the plurality of inductors may be disposed in parallel, and at least two power inductors may be provided in one body 100.

As described above, in accordance with the foregoing embodiment described with reference to FIGS. 21 to 32, the plurality of base materials 200, on which the coil patterns 300 disposed on the at least one surface within the body 10 are disposed, may be laminated in the thickness direction (i.e., the vertical direction) of the body 100 or arranged in the direction perpendicular to (the horizontal direction) the body 100. Also, the coil patterns 300 respectively disposed on the plurality of base materials 200 may be connected to the external electrodes 400 in series or parallel. That is, the coil patterns 300 respectively disposed on the plurality of base materials 200 may be connected to the external electrodes 400 different from each other and arranged in parallel, and the coil patterns 300 respectively disposed on the plurality of base materials 200 may be connected to the same external electrode 400 and arranged in series. When the coil patterns 300 are connected in series, the coil patterns 300 respectively disposed on the base materials 200 may be connected to the connection electrodes 700 outside the body 100. Thus, when the coil patterns 300 are connected in parallel, two external electrodes 400 may be required for the plurality of base materials 200. When the coil patterns 300 are connected in series, two external electrodes 400 and at least one connection electrode 700 may be required regardless of the number of base materials 200. For example, when the coil patterns 300 disposed on the three base materials 200 are connected to the external electrodes in parallel, six external electrodes 400 may be required. When the coil patterns 300 disposed on the three base materials 200 are connected in series, two external electrodes 400 and at least one connection electrode 700 may be required. Also, when the coil patterns 300 are connected in parallel, a plurality of coils may be provided within the body 100. When the coil patterns 300 are connected in series, one coil may be provided within the body 100.

Figure 33:
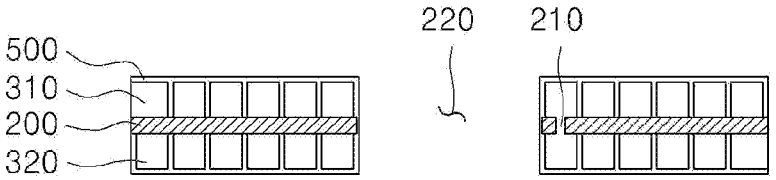
FIGS. 33 to 35 are cross-sectional views for sequentially explaining a method for manufacturing the power inductor in accordance with an exemplary embodiment.
Figure 34:
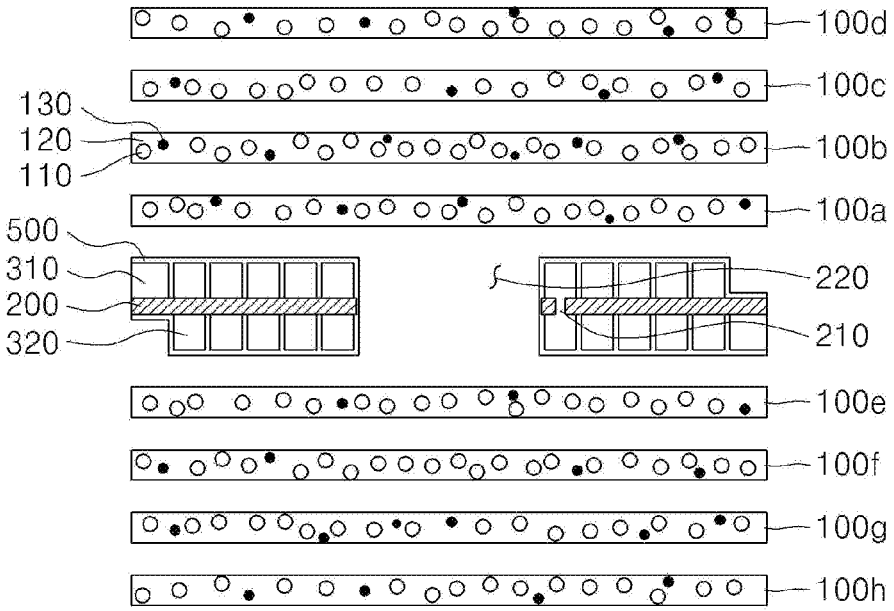
Figure 35:
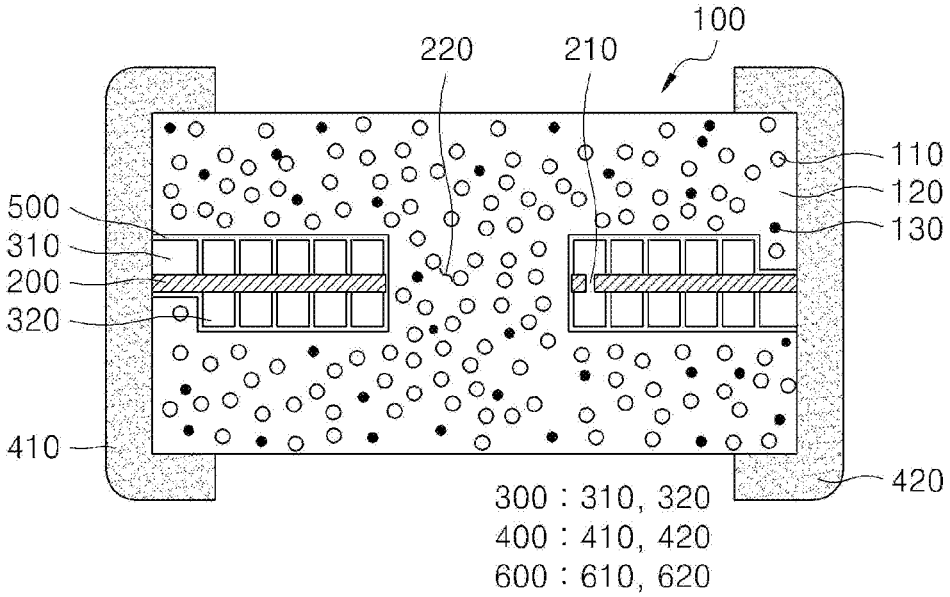

FIGS. 33 to 35 are cross-sectional views for sequentially explaining a method for a power inductor in accordance with an exemplary embodiment.

Referring to FIG. 33, coil patterns 310 and 320 having a predetermined shape may be formed on at least one surface of a base material 200, i.e., one surface and the other surface of the base material 200. The base material 200 may be manufactured by using a CCL or metal magnetic material, preferably, a metal magnetic material that is capable of easily realizing an increase of actual magnetic permeability. For example, the base material 200 may be manufactured by bonding copper foil to one surface and the other surface of a metal plate having a predetermined thickness and made of a metal alloy containing iron. Here, a through hole 220 may be formed in a central portion of the base material 200, and a conductive via 201 may be formed in a predetermined region of the base material 200. Also, the base material 200 may have a shape in which an outer region except for the through hole 220 is removed. For example, the through hole 220 may be formed in a central portion of the base material having a rectangular shape with a predetermined thickness, and the conductive via 210 may be formed in the predetermined region. Here, at least an outer portion of the base material 200 may be removed. Here, the removed portion of the base material 200 may be outer portions of the coil patterns 310 and 320 formed in a spiral shape. Also, the coil patterns 310 and 320 may be formed on a predetermined area of the base material 200, e.g., in a circular spiral shape from the central portion. Here, the coil pattern 310 may be formed on one surface of the base material 20, and a conductive via 210 passing through a predetermined region of the base material 200 and filled with a conductive material may be formed. Then, the coil pattern 320 may be formed on the other surface of the base material 200. The conductive via 210 may be formed by filling conductive paste into a via hole after the via hole is formed in a thickness direction of the base material 200 by using laser. Also, the coil pattern 310 may be formed through, for example, a plating process. For this, a photosensitive pattern may be formed on one surface of the base material 200, and the plating process using the copper foil on the base material 200 as a seed may be performed to grow a metal layer from a surface of the exposed base material 200. Then, the photosensitive film may be reduced to form the coil pattern 310. Also, the coil pattern 320 may be formed on the other surface of the base material 200 through the same method as the coil pattern 310. The coil patterns 310 and 320 may be disposed to form a multilayer structure. When the coil patterns 310 and 320 have the multilayer structure, the insulation layer may be disposed between a lower layer and an upper layer. Then, a second conductive via (not shown) may be formed in the insulation layer to connect the multilayered coil patterns to each other. As described above, the coil patterns 310 and 320 may be formed on the one surface and the other surface of the base material 20, and then, an insulation layer 500 may be formed to cover the coil patterns 310 and 320. Also, the insulation layer 500 may be formed by applying an insulation polymer material such as parylene. Preferably, the insulation layer 500 may be formed on top and side surfaces of the base material 200 as well as top and side surfaces of the coil patterns 310 and 320 because of being coated with the parylene. Here, the insulation layer 500 may be formed on the top and side surfaces of the coil patterns 310 and 320 and the top and side surfaces of the base material 200 at the same thickness. That is, the base material 200 on which the coil patterns 310 and 320 are formed may be provided in a deposition chamber, and then, the parylene may be evaporated and supplied into the vacuum chamber to deposit the parylene on the coil patterns 310 and 320 and the base material 200. For example, the parylene may be primarily heated and evaporated in a vaporizer to become a dimer state and then be secondarily heated and pyrolyzed into a monomer state. Then, when the parylene is cooled by using a cold trap connected to the deposition chamber and a mechanical vacuum pump, the parylene may be converted from the monomer state to a polymer state and thus be deposited on the coil patterns 310 and 320. Here, a primary heating process for forming the dimer state by evaporating the parylene may be performed at a temperature of 100° C. to 200° C. and a pressure of 1.0 Torr. A secondary heating process for forming the monomer state by pyrolyzing the evaporated parylene may be performed at a temperature of 400° C. to 500° C. degrees and a pressure of 0.5 Torr. Also, the deposition chamber for depositing the parylene in a state of changing the monomer state into the polymer state may be maintained at a temperature of 25° C. and a pressure of 0.1 Torr. Since the parylene is applied to the coil patterns 310 and 320, the insulation layer 500 may be applied along a stepped portion between each of the coil patterns 310 and 320 and the base material 200, and thus, the insulation layer 500 may be formed with the uniform thickness. Alternatively, the insulation layer 500 may be formed by closely attaching a sheet including at least one material selected from the group consisting of epoxy, polyimide, and liquid crystal crystalline polymer to the coil patterns 310 and 320.

Referring to FIG. 34, a plurality of sheets 100*a* to 100*h* made of a material including the magnetic pulverized material 110 and the insulation material 120 may be provided. The plurality of sheets 100*a* to 100*h* are disposed on upper and lower portions of the base material 200 on which the coil patterns 310 and 320 are formed, respectively. Also, as proposed in another exemplary embodiment, first and second magnetic layers 610 and 620 may be respectively disposed on top and bottom surfaces of the uppermost and lowermost sheets 100*a* and 100*h*. Each of the first and second magnetic layers 610 and 620 may be manufactured by using a material having magnetic permeability greater than that of each of the sheets 100*a* to 100*h*. For example, each of the first and second magnetic layers 610 and 620 may be manufactured by using magnetic powder and an epoxy resin so that the first and second magnetic layers 610 and 620 have magnetic permeability greater than those of the sheets 100*a* to 100*h*. Also, a thermal conductive filler may be further provided in each of the first and second magnetic layers 610 and 620.

Referring to FIG. 35, the plurality of sheets 100*a* to 100*h*, which are alternately disposed with the base material 200 therebetween, may be laminated and compressed and then molded to form the body 100. As a result, the body 100 may be filled into the through hole 220 of the base material 200 and the removed portion of the base material 200. Also, although not shown, each of the body 100 and the base material 200 may be cut into a unit of a unit device, and then the external electrode 400 electrically connected to the withdrawn portion of each of the coil patterns 310 and 320 may be formed on both ends of the body 100. The body 100 may be immersed into the conductive paste, the conductive paste may be printed on both ends of the body 10, or the deposition and sputtering may be performed to the form the external electrode 400. Here, the conductive paste may include a metal material that is capable of giving electrical conductive to the external electrode 400. Also, a Ni-plated layer and a Sn-plated layer may be further formed on a surface of the external electrode 400 as necessary.

The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims.

What is claimed is:

1. A power inductor comprising:

a body;

at least one base material disposed within the body;

at least one coil pattern disposed on at least one surface of the base material; and an external electrode disposed outside the body, wherein the body comprises metal magnetic powder, a magnetic pulverized material and an insulation material, wherein 0.1 wt % to 5 wt % of the magnetic pulverized material is contained with respect to 100 wt % of a mixture of the metal magnetic powder and the magnetic pulverized material.

2. The power inductor of claim 1, further comprising an insulation capping layer disposed on an upper portion of the body.

3. The power inductor of claim 2, wherein the capping insulation layer is disposed on at least a portion of a remaining area except for an area on which the external electrode is mounted on a printed circuit board.

4. The power inductor of claim 1, wherein the magnetic pulverized material is manufactured by pulverizing a magnetic sintered body to a predetermined size.

5. The power inductor of claim 1, wherein the body further comprises a thermal conductive filler.

6. The power inductor of claim 1, further comprising an insulation layer disposed between the coil pattern and the body.

7. The power inductor of claim 5, wherein the thermal conductive filler comprises at least one selected from the group consisting of MgO, AlN, carbon-based materials, Ni-based ferrite, and ferrite.

8. The power inductor of claim 1, further comprising at least one magnetic layer disposed on the body.

9. The power inductor of claim 8, wherein the magnetic layer is manufactured by mixing at least one of the magnetic pulverized material and metal magnetic powder with the insulation material or by using a magnetic sintered body or a metal ribbon.

10. The power inductor of claim 1, wherein at least a region of the base material is removed, and the body is filled into the removed region.

11. The power inductor of claim 10, further comprising an insulation layer disposed between the coil pattern and the body; and wherein a magnetic layer and the insulation layer are alternately disposed in the removed region of the base material, or a magnetic material is disposed in the removed region of the base material.

12. The power inductor of claim 1, wherein the coil patterns disposed on the one surface and the other surface of the base material have the same height.

13. The power inductor of claim 1, wherein at least one region of the coil pattern has a different width.

14. The power inductor of claim 6, wherein the insulation layer is disposed on top and side surfaces of the coil pattern at a uniform thickness and has the same thickness as each of top and side surfaces of the coil pattern on the base material.

15. The power inductor of claim 1, wherein at least a portion of the external electrode is made of the same material as the coil pattern.

16. The power inductor of claim 1, wherein the coil pattern is formed on at least one surface of the base material through a plating process, and an area of the external electrode, which contacts the coil pattern, is formed through the plating process.

* * * * *